US009522422B2

(12) United States Patent
Kaneko

(10) Patent No.: US 9,522,422 B2
(45) Date of Patent: Dec. 20, 2016

(54) FORGING DEVICE AND FORGING METHOD

(71) Applicant: KAGA, INC., Kanagawa (JP)

(72) Inventor: Shuhei Kaneko, Ishikawa (JP)

(73) Assignee: KAGA, INC., Kanagawa (JP)

( * ) Notice: Subject to any disclaimer, the term of this patent is extended or adjusted under 35 U.S.C. 154(b) by 0 days.

(21) Appl. No.: 14/888,855

(22) PCT Filed: Mar. 11, 2014

(86) PCT No.: PCT/JP2014/056257

§ 371 (c)(1),
(2) Date: Nov. 3, 2015

(87) PCT Pub. No.: WO2014/185138

PCT Pub. Date: Nov. 20, 2014

(65) Prior Publication Data

US 2016/0074929 A1 Mar. 17, 2016

(30) Foreign Application Priority Data

May 16, 2013 (JP) ..... 2013-104006

(51) Int. Cl.

| | |
|---|---|
| ***B21J 9/02*** | (2006.01) |
| ***B21J 5/02*** | (2006.01) |
| ***B21K 21/02*** | (2006.01) |
| *B21D 22/28* | (2006.01) |

(52) U.S. Cl.

CPC ..... *B21J 9/022* (2013.01); *B21J 5/022* (2013.01); *B21J 9/02* (2013.01); *B21K 21/02* (2013.01); *B21D 22/28* (2013.01)

(58) Field of Classification Search

CPC ..... B21J 9/022; B21J 9/02; B21J 5/022; B21J 5/02; B21J 13/02; B21K 21/02; B21D 22/28

See application file for complete search history.

(56) References Cited

FOREIGN PATENT DOCUMENTS

| | | |
|---|---|---|
| CN | 1621198 | 6/2005 |
| CN | 102215997 | 10/2011 |
| CN | 102489578 | 6/2012 |

(Continued)

OTHER PUBLICATIONS

Search Report issued by PCT/JP2014/056257 patent office in PCT/JP2014/056257 Patent Application No. , dated Jun. 3, 2014.

(Continued)

*Primary Examiner* — Teresa M Ekiert

(74) *Attorney, Agent, or Firm* — Greenblum & Bernstein P.L.C.

(57) ABSTRACT

A forging device that shapes a raw material for forging includes an upper mold and a lower mold that compress a raw material, an upper punch provided to be pierceable through a first hole part formed in the upper mold, a lower punch provided to be pierceable through a second hole part formed in the lower mold, and a drive control part that performs control of driving the upper and lower molds and control of driving the upper punch and/or the lower punch. In accordance with a decreased amount of a thickness of a raw material portion compressed by the upper punch and the lower punch the drive control part performs drive control to move the raw material portion compressed by the upper and lower molds to a side of the upper mold and enlarge a cylindrical part formed by causing a material to flow into a gap between the upper punch and the second hole part.

17 Claims, 14 Drawing Sheets

(56) References Cited

FOREIGN PATENT DOCUMENTS

| | | |
|---|---|---|
| DE | 1452495 | 3/1969 |
| JP | 07-001067 | 1/1995 |
| JP | 07-266100 | 10/1995 |
| JP | 2001-137961 | 5/2001 |
| JP | 2006-272458 | 10/2006 |

OTHER PUBLICATIONS

Office Action issued in China Counterpart Patent Appl. No. 201480026857.9, dated Aug. 3, 2016, along with an English translation thereof.

5

5

5

5

5

5

5

5

5

5

FORGING DEVICE AND FORGING METHOD

TECHNICAL FIELD

The present invention relates to a forging device and a forging method.

BACKGROUND ART

There is known a press machine that performs processing for pressing a tabular metal raw material with a pair of molds (see, for example, Patent Document 1).

There is known a device that manufactures a bottomed cylindrical body from a plate material of metal through drawing ironing processing. Drawing processing is a processing method for bringing the peripheral portion of the plate material or the like close to the center to process the plate material into a container shape. Ironing processing is a processing method for smoothing the surface of the plate material while slightly reducing the thickness of the plate material. Drawing/ironing processing is a composite processing method for simultaneously performing the ironing processing while drawing the material.

When manufacturing a large square case from a metal plate material of aluminum or the like, a general drawing ironing processing device performs a first drawing/ironing process (approximately five processes), an intermediate trim process (a cutoff process for an edge portion), a second drawing/ironing process (approximately three processes), a finish trim process (a cutoff process for an edge portion), and the like. As the metal plate material, for example, a clad material is also used. Examples of the clad material include aluminum/copper, nickel/stainless steel/copper, and aluminum/nickel.

Incidentally, there is known an impact processing device that performs shaping with an impact processing method. The impact processing device gives a shock to a metal ingot called slug through punching to shape a bottomed cylindrical body.

RELATED ART LITERATURE

Patent Document

Patent Document 1: Japanese Patent Application Laid-Open No. H7-266100

SUMMARY OF THE INVENTION

Technical Problem

However, the device that performs the general drawing ironing processing performs the drawing/ironing processing through multiple processes such as five to eight processes. Therefore, a relatively long processing time is required. The device that performs the drawing/ironing processing needs a mold and a press machine having complicated structures.

The drawing/ironing processing device needs to perform the intermediate trim processing, the finish trim processing, and the like after the drawing/ironing processing. A material use ratio, which is a ratio of a product weight to the weight of a material, is approximately 50%, which is a low material use ratio.

In the impact processing device, when cylindrical shaping is performed by punching with a backward extrusion method of an open system, the plate thickness of a sidewall of a shaped case is sometimes non-uniform.

The present invention has been devised in view of the problems and it is an object of the present invention to, for example, provide a forging device and a forging method for the forging device that can simply and highly accurately perform, in a short time, processing for forging a raw material such as a plate material into a bottomed cylindrical shape and provide a forging device and a forging method for the forging device that can perform processing having a high material use ratio.

Solution To Problem

A forging device of the present invention is a forging device that shapes a raw material of forging, the forging device including: a first mold and a second mold that compress the raw material; a first punch provided to be pierceable through a first hole part formed in the first mold; a second punch provided to be pierceable through a second hole part formed in the second mold; and a drive control part that performs control to drive the first mold and the second mold and control to drive the first punch and/or the second punch. The second hole part formed in the second mold is formed in a position corresponding to the first punch and formed with an inner dimension larger than the outer dimension of an end part of the first punch. When the drive control part performs control to drive the first punch and/or the second punch to decrease a thickness of a raw material portion compressed by the first punch and the second punch, in accordance with a decreased amount of the thickness of the raw material portion compressed by the first punch and the second punch, in a state in which the thickness of the raw material portion compressed by the first mold and the second mold is substantially maintained, the drive control part performs drive control to move the raw material portion compressed by the first mold and the second mold to a side of the first mold and enlarge a cylindrical part formed by causing a material to flow into a gap between the first punch and the second hole part.

A forging method for a forging device that shapes a raw material of forging of the present invention, the forging device including: a first mold and a second mold that compress the raw material; a first punch provided to be pierceable through a first hole part formed in the first mold; a second punch provided to be pierceable through a second hole part formed in the second mold; and a drive control part that performs control to drive the first mold and the second mold and control to drive the first punch and/or the second punch, the second hole part formed in the second mold being formed in a position corresponding to the first punch and formed with an inner dimension larger than the outer dimension of an end part of the first punch, and the forging method including: a step in which the drive control part compresses the raw material with the first mold and the second mold; and a step in which, when the drive control part performs control to drive the first punch and/or the second punch to decrease a thickness of a raw material portion compressed by the first punch and the second punch, in accordance with a decreased amount of the thickness of the raw material portion compressed by the first punch and the second punch, in a state in which a thickness of the raw material portion compressed by the first mold and the second mold is substantially maintained, the drive control part performs drive control to move the raw material portion compressed by the first mold and the second mold to a side of the first mold and enlarge a cylindrical part formed by causing a material to flow into a gap between the first punch and the second hole part.

Advantageous Effects Of The Invention

According to the present invention, it is possible to provide a forging device and a forging method for the forging device that can simply and highly accurately perform, in a short time, processing for forging a raw material such as a plate material into a bottomed cylindrical shape According to the present invention, it is possible to provide a forging device and a forging method for the forging device that can perform processing having a high material use ratio.

DESCRIPTION OF EMBODIMENTS

Figure 1:
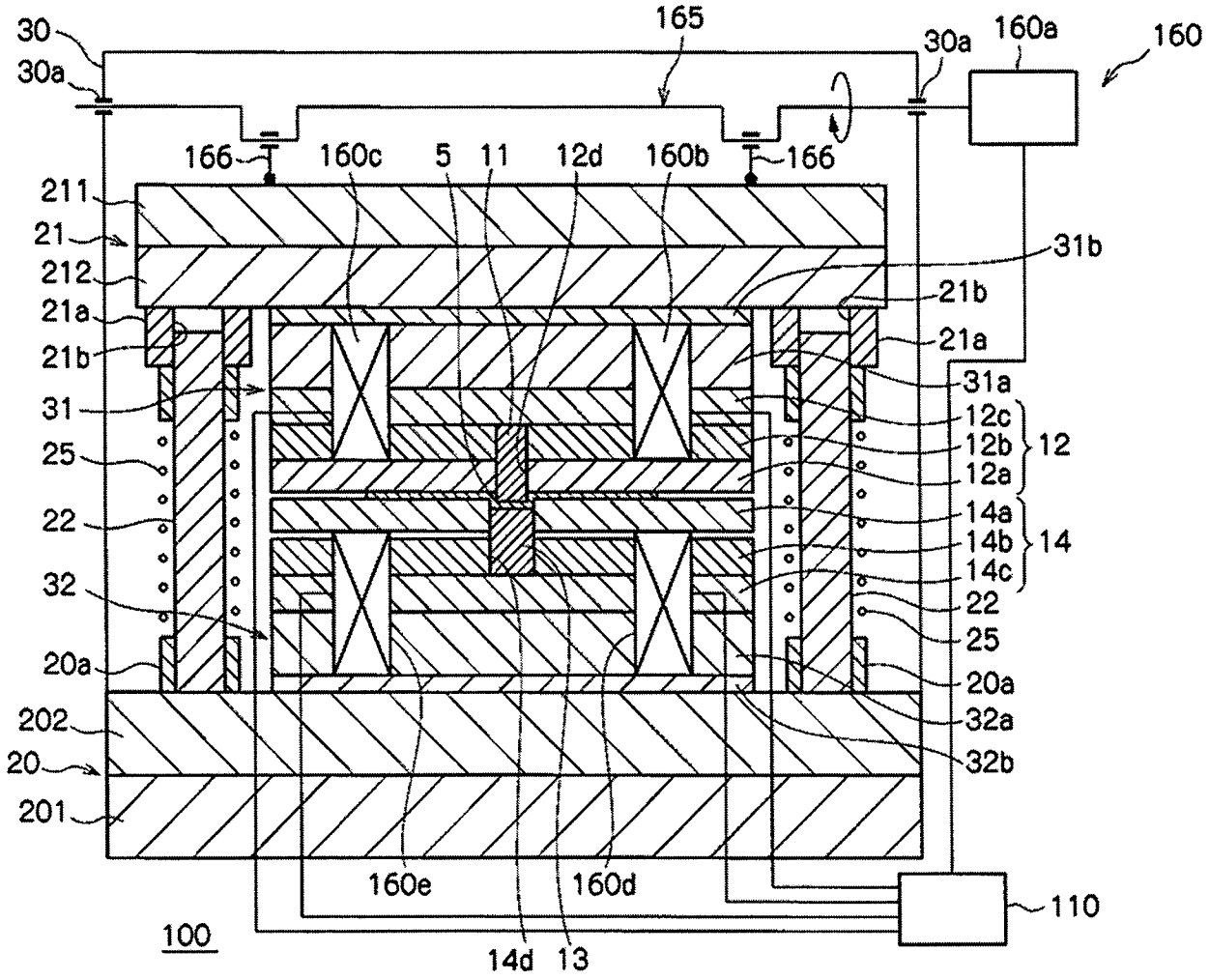
FIG. 1 is a diagram showing an example of a forging device according to an embodiment of the present invention.
Figure 2:
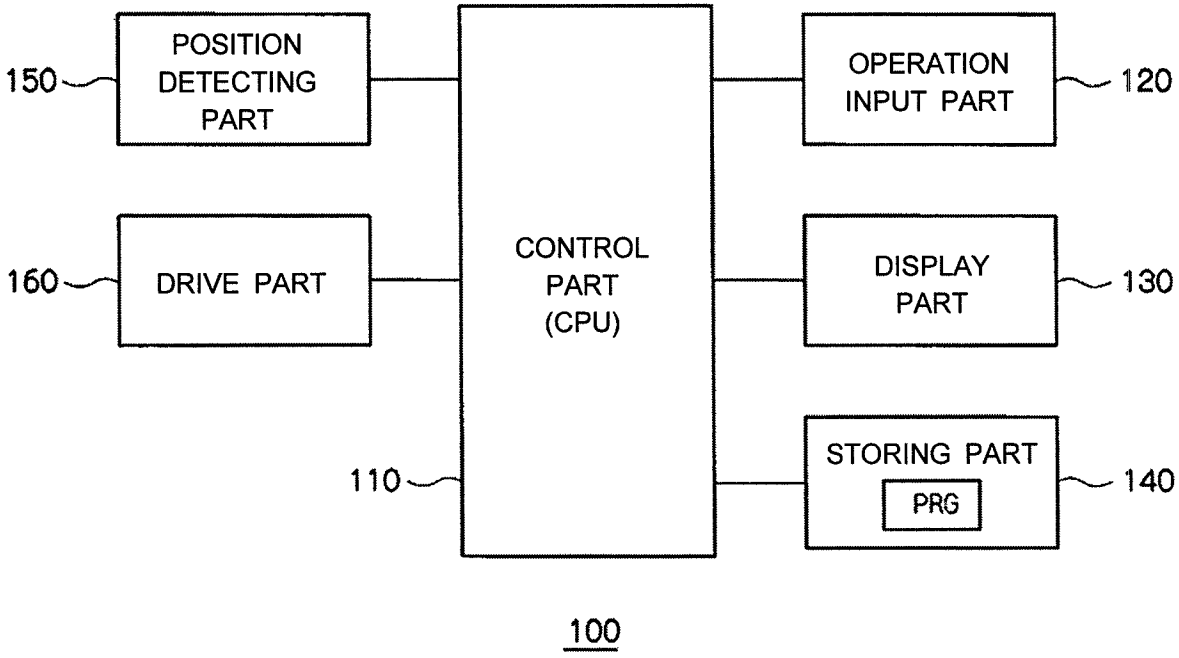
FIG. 2 is a diagram showing an example of an electric configuration of the forging device according to the embodiment of the present invention.

A forging device according to an embodiment of the present invention is explained with reference to the drawings. FIG. 1 is a diagram showing an example of a forging device 100 according to the embodiment of the present invention. FIG. 2 is a diagram showing an example of an electric configuration of the forging device 100.

The forging device 100 according to the embodiment of the present invention shapes a plate material, which is a raw material 5 of forging, a preliminarily shaped raw material, or the like through forging processing and manufactures a bottomed cylindrical body 5*t*. Specifically, in this embodiment, the forging device 100 shapes metal such as aluminum, which is a forging raw material, into a bottomed square cylindrical body (a square case) through the forging processing. Note that the forging device 100 may be configured to manufacture a bottomed cylindrical body 5*t* such as a circular cylindrical body or a polygonal cylindrical body.

As shown in FIG. 1, the forging device 100 according to the embodiment of the present invention includes a first punch 11 (an upper punch), a second punch 13 (a lower punch), an upper mold 12, a lower mold 14, an upper spring holder 31*a* (an upper die set), an upper pressing plate 31*b*, a lower spring holder 32*a* (a lower die set), and a lower pressing plate 32*b*. An upper block 31 includes the upper spring holder 31*a* (the upper die set) and the upper pressing plate 31*b*. A lower block 32 includes the lower spring holder 32*a* (the lower die set) and the lower pressing plate 32*b*.

The upper mold 12 includes a stripper 12*a*, an upper holder 12*b*, and an upper plate 12*c*. The lower mold 14 includes a movable lower die 14*a* (a lower stripper), a lower holder 14*b*, and a lower plate 14*c*.

As shown in FIG. 1 and FIG. 2, the forging device 100 includes a control part 110 (a CPU), an operation input part 120, a display part 130, a storing part 140, a position detecting part 150, and a drive part 160 (160*a*, 160*b*, 160*c*, 160*d*, and 160*e*).

In the forging device 100, a slide member 21 (an upper die set, etc.) is disposed movably in the up-down direction on a base 20 made of metal. In this embodiment, the base 20 is formed in a rectangular shape. Rods 22 functioning as slide guides are provided respectively near corners.

In this embodiment, the base 20 includes a press bolster 201 and a lower die set 202 disposed on the press bolster 201. The slide member 21 includes a press slide 211 and an upper die set 212 provided under the press slide 211.

The rods 22 are disposed between the base 20 and the upper die set 212 and support the upper die set 212 movably in the up-down direction. Specifically, protrusion parts 21*a* are respectively provided near corner end parts of the lower surface of the upper die set 212 by a plurality of rods 22. Hole parts 21*b* are formed in the protrusion parts 21*a*. The upper end parts of the rods 22 slidably fit in the hole parts 21*b*. The lower end parts of the rods 22 are fixed to the base 20 via protrusion parts 20*a* provided in the base 20.

A die set guide includes a urge members 25 and the rods 22. The dies set guide is configured to correctly keep a positional relation between the upper die set and the lower die set.

Specifically, the urge members 25 such as springs are provided in the outer circumferential parts of the rods 22. The urge members 25 are configured such that lower end parts are in contact with the upper ends of the protrusion parts 20*a* provided on the upper surface of the base 20 and upper end parts are in contact with the protrusion parts 21*a* provided on the lower surface of the slide member 21. That is, the urge member 25 is configured to urge the upper die set 212 upward.

Above the upper die set 212 and the press slide 211, a drive part 160*a* that drives the upper die set 212 and the press slide 211 in the up-down direction is disposed. In this embodiment, for example, as shown in FIG. 1, a crankshaft 165 and connecting rods 166 are provided above the press slide 211. The crankshaft 165 is rotatably supported in near both end parts thereof by, for example, hole parts 30*a* provided in a supporting member 30 fixed to the lower die set 202.

The slide member 21 (the upper die set 212 and the press slide 211) connected to the crankshaft 165 via the connecting rods 166 is configured to move in the up-down direction when the drive part 160*a* drives to rotate the crankshaft 165.

The upper pressing plate 31*b* is provided under the upper die set 212. The upper mold 12 is provided below the upper pressing plate 31*b*. Specifically, the upper plate 12*c* is provided below the upper pressing plate 31*b*, the upper holder 12*b* is provided under the upper plate 12*c*, and the stripper 12*a* is provided under the upper holder 12*b*.

In the upper mold 12, a hole part 12*d* is provided substantially in the center. The upper mold 12 is configured such that the upper punch 11 slidably pierces through the hole part 12*d* of the upper mold 12. Specifically, the upper mold 12 has structure in which the hole part 12*d* is provided substantially in the center of the stripper 12*a* and the upper holder 12*b* and the upper end part of the upper punch 11 is connected to the upper plate 12*c* and fixed. That is, the upper plate 12*c* is a member that is disposed in contact with the upper end part of the upper punch 11 and receives force of the upper punch 11. The upper holder 12*b* is a plate member that stores the upper punch 11.

The stripper 12*a* is configured to strip a forging-processed material from the upper mold 12. The stripper 12*a* is configured to press a forging target raw material 5 while the forging target raw material 5 is forging-processed. The stripper 12*a* has structure in which, when springs are used in the drive parts (160*b* and 160*c*), the springs and the pressing plate 31*b* are connected.

The upper punch 11 is formed in a columnar shape such as a square pole shape or a columnar shape. In this embodiment, the upper punch 11 is formed in a square pole shape. The upper punch 11 is configured such that the length along the up-down direction of the upper punch 11 is larger than the length in the thickness direction (the up-down direction) of the upper mold 12.

That is the upper punch 11 is configured such that the lower end part thereof projects further than the lower end of the upper mold 12 when the upper mold 12 moves in a direction toward the slide member 21.

The drive part 160*b* and the drive part 160*c* are disposed between the upper pressing plate 31*b* and the stripper 12*a*. The stripper 12*a* of the upper mold 12 is configured to be movable, with the drive parts 160*b* and 160*c*, in a direction in which the stripper 12*a* and the slide member 21 separate from each other and a direction in which the stripper 12*a* and the slide member 21 approach each other. Specifically, the drive parts 160*b* and 160*c* are configured by a hydraulic pressure, an air pressure, a motor, or a spring, a combination of two or more of the foregoing, or the like such that movable parts of the drive parts 160*b* and 160*c* extend and retract with respect to fixed parts of the drive part 160*b* and 160*c*. That is, the forging device 100 is configured to be capable of adjusting the distance between the upper mold 12 (the stripper 12*a*) and the upper holder 12*b* according to the control by the control part 110.

The lower pressing plate 32*b* is provided on the lower die set 202 of the base 20. The lower spring holder 32*a* is provided on the lower pressing plate 32*b*. The lower mold 14 is provided on the lower spring holder 32*a*. Specifically, the lower plate 14*c* is provided on the lower spring holder 32*a*, the lower holder 14*b* is provided on the lower plate 14*c*, and the movable lower die 14*a* (the lower stripper) is provided on the lower holder 14*b*.

That is, the lower plate 14*c* is a plate that is disposed in contact with the lower end part of the lower punch 13 and receives force of the lower punch 13.

The lower mold 14 is configured such that a hole part 14*d* is provided substantially in the center and the lower punch 13 slidably pierces through the hole part 14*d*. Specifically, the lower mold 14 has structure in which the hole part 14*d* is provided substantially in the center of the movable lower die 14*a* and the lower holder 14*b* and the lower end part of the lower punch 13 is connected to the lower plate 14*c* and fixed. The lower holder 14*b* is a plate member that stores the lower punch 13.

The movable lower die 14*a* (a lower stripper) is configured to strip a forging-processed material from the lower mold 14. The movable lower die 14*a* is configured to press the forging target raw material 5 while the forging target raw material 5 is forging-processed. For example, the movable lower die 14*a* has structure in which, when springs are used in the drive parts (160*d* and 160*e*), the springs and the pressing plate 32*b* are connected.

A second hole part (the hole part 14*d*) formed in a second mold (the lower mold 14) is formed in a position corresponding to a first punch (the upper punch 11) and formed with an inner dimension larger than the outer dimension of the end part of the first punch (the upper punch 11).

The lower punch 13 is formed in a column shape such as a square pole shape or a columnar shape. In this embodiment, the lower punch 13 is formed in a square pole shape. The lower punch 13 is configured such that the length along the up-down direction of the lower punch 13 is substantially the same as the length in the thickness direction (the up-down direction) of the lower mold 14.

The lower punch 13 is configured such that the upper end part of the lower punch 13 further recess than the upper end of the lower mold 14 when the lower mold 14 moves in a direction away from the base 20 (or the lower pressing plate 32*b*). The size of the upper end part of the lower punch 13 and the hole part 14*d* of the lower mold 14 (the size in a direction orthogonal to a moving direction of the upper punch 11) is formed larger than the size of the lower end part of the upper punch 11 (the size in the direction orthogonal to the moving direction of the upper punch 11).

The drive part 160*d* and the drive part 160*e* are disposed between the lower pressing plate 32*b* and the movable lower die 14*a*. The movable lower die 14*a* of the lower mold 14 is configured to be movable, with the drive parts 160*d* and 160*e*, in a direction in which the movable lower die 14*a* of the lower mold 14 and the lower die set 202 (or the lower pressing plate 32*b*) separate from each other and a direction in which the movable lower die 14*a* of the lower mold 14 and the lower die set 202 approach each other. Specifically, the drive parts 160*d* and 160*e* are configured by a hydraulic pressure, an air pressure, a motor, or a spring, a combination of two or more of the foregoing, or the like such that movable parts of the drive parts 16*d* and 160*e* extend and retract with respect to fixed parts of the drive part 160*d* and 160*e*. That is, the forging device 100 is configured to be capable of adjusting the distance between the movable lower die 14*a* of the lower mold 14 and the lower die set 202 (or the lower pressing plate 32B) according to the control by the control part 110.

The forging device 100 is configured such that, when the upper punch 11 punches a plate material serving as the forging raw material 5, a gap is formed between the upper punch 11 and the sidewall of the hole part 14*d* of the lower mold 14, and a material flow occurs to fill the gap with plastic deformation of the material of the raw material 5.

The forging device 100 according to the embodiment of the present invention shapes the raw material 5 (the plate material, etc.) made of metal, which is a forging raw material, through backward extrusion forging processing.

The forging device 100 shapes the raw material 5 such as the plate material through backpressure applying forging processing. The backpressure applying forging processing is a processing method for performing forging to plastically deform a material while improving fluidity by applying a backpressure to a material outflow port and increasing a hydrostatic pressure in a plastically deformed region.

The forging device 100 shapes the raw material 5 such as the plate material through cold forging processing. The cold forging processing is a processing method for forging a raw material at the normal temperature without heating the raw material.

As shown in FIG. 1 and FIG. 2, the forging device 100 includes the control part 110 (the CPU), the operation input part 120, the display part 130, the storing part 140, the position detecting part 150, and the drive part 160. The components are electrically connected by a communication path such as a bus.

The control part 110 collectively controls the components of the forging device 100. Specifically, the control part 110 executes a program (PRG) such as a control program stored in the storing part to thereby realize functions related to the present invention in the forging device 100 (a computer). A detailed function of the control part 110 is explained below.

The operation input part 120 is an operation input device such as various operation buttons, various switches, a keyboard, a mouse, or a touch panel. The operation input part 120 outputs an operation signal corresponding to operation by a user or the like to the control part 110.

The display part 130 displays, according to the control by the control part 110, various kinds of information and the like of the forging device according to the present invention.

The storing part 140 is configured by a storage device such as a RAM, a ROM, or an external storage device. The storing part 140 stores a computer program, various control parameters, and the like for realizing the functions related to the present invention.

The position detecting part 150 detects positions of the upper punch 11, the upper mold 12, the lower punch 13, the lower mold 14, and the like and outputs detection signals indicating the positions to the control part 110. The position detecting part 150 may be provided as appropriate according to necessity.

The drive part 160 drives the upper punch 11, the upper mold 12, the lower punch 13, the lower mold 14, and the like according to the control by the control part 110. Specifically, the drive part 160 includes the drive part 160*a*, the drive part 160*b*, the drive part 160*c*, and the drive part 160*d*.

The drive part 160*a* is configured by a hydraulic pressure, an air pressure, an electric motor, or the like. The drive part 160*a* drives, for example, the crankshaft 165, the connecting rods 166, and the like to lift and lower the upper die set 212 and the like.

The drive part 160*b* and the drive part 160*c* are provided in, for example, the stripper 12*a* of the upper mold 12 and the upper die set 212 and configured to be movable in a direction in which the upper mold 12 and the upper die set 212 separate from each other and a direction in which the upper mold 12 and the upper die set 212 approach each other. Specifically, the drive parts 160*b* and 160*c* are configured by a hydraulic pressure, an air pressure, a motor, or a spring, a combination of two or more of the foregoing, or the like such that the movable parts of the drive parts 160*b* and 160*c* extend and retract with respect to the fixed parts of the drive part 160*b* and 160*c*. That is, the forging device 100 is configured to be capable of adjusting the distance between the stripper 12*a* of the upper mold 12 and the upper die set 212 according to the control by the control part 110.

The drive parts 160*d* and 160*e* are configured to be movable in a direction in which the movable lower die 14*a* of the lower mold 14 and the lower die set 202 separate from each other and a direction in which the movable lower die 14*a* of the lower mold 14 and the lower die set 202 approach each other. Specifically, the drive parts 160*d* and 160*e* are configured by a hydraulic pressure, an air pressure, a motor, or a spring, or the like such that the movable parts of the drive parts 160*d* and 160*e* extend and retract with respect to the fixed parts of the drive part 160*d* and 160*e*. That is, the forging device 100 is configured to be capable of adjusting the distance between the movable lower die 14*a* of the lower mold 14 and the lower die set 202 according to the control by the control part 110.

The drive part 160 and the control part 110 (the CPU) correspond to the drive control part.

The drive control part performs control of driving the stripper 12*a* of a first mold 12 and the movable lower die 14*a* of a second mold 14 and control of driving the first punch 11 and/or the second punch 13.

When the drive control part performs control of driving the first punch 11 and the second punch 13 to decrease the thickness of a raw material portion 5*b* compressed by the first punch 11 and the second punch 13, in accordance with a decreased amount (a volume decreased amount: a decrease portion 5*ed*) of thickness 5*e* of the raw material portion 5*b* compressed by the first punch (the upper punch 11) and the second punch (the lower punch 13), in a state in which the thickness of a raw material portion compressed by the first mold (the stripper 12*a* of the upper mold 12) and the second mold (the movable lower die 14*a* of the lower mold 14) is substantially maintained, the drive control part performs drive control to move the raw material portion 5*a* compressed by the first mold (the stripper 12*a* of the upper mold 12) and the second mold (the movable lower die 14*a* of the lower mold 14) to the first mold (the stripper 12*a* of the upper mold 12) side and enlarge a cylindrical part 5*p* formed by causing a material to flow into a gap between the first punch (the upper punch 11) and the second hole part 14*d*.

Specifically, for example, the drive control part performs drive control to move the raw material portion compressed by the first mold (the stripper 12*a* of the upper mold 12) and the second mold (the movable lower die 14*a* of the lower mold 14) to the first mold 12 (the stripper 12*a* of the upper mold 12) side such that the decreased amount (the volume decreased amount: the decrease portion 5*ed*)of the thickness of the raw material portion compressed by the first punch 11 and the second punch 13 and an increase amount (a volume increase amount: an increase portion 5*pd*) of the cylindrical part 5*p* formed by causing a material to flow into the gap between the first punch 11 (the upper punch) and the second hole part 14*d* are the same or substantially the same.

In this embodiment, the drive control part drives the drive parts 160*b*, 160*c*, 160*d*, and 160*e* to move the stripper 12*a* of the upper mold 12 and the movable lower die 14*a* of the lower mold 14 to the first mold (the stripper 12*a* of the upper mold 12) side in a state in which the lower punch 13 is fixed.

Note that, when the drive control part performs control of driving the first punch 11 and the second punch 13 to decrease the thickness of the raw material portion 5*b* compressed by the first punch 11 and the second punch 13, in accordance with the decreased amount (the volume decreased amount: the decrease portion 5*ed*) of the thickness 5*e* of the raw material portion 5*b* compressed by the first punch (the upper punch 11) and the second punch (the lower punch 13), in a state in which the thickness of the raw material portion compressed by the first mold (the stripper 12*a* of the upper mold 12) and the second mold (the movable lower die 14*a* of the lower mold 14) is substantially maintained, the drive control part may perform drive control to move the raw material portion compressed by the first punch 11 and the second punch 13 to the second punch 13 side and enlarge the cylindrical part 5*p* formed by causing a material to flow into the gap between the first punch (the upper punch 11) and the second hole part 14*d*.

The cylindrical part 5*p* includes a desired cylinder shape such as a circular cylindrical shape, a polygonal cylinder, or a doughnut shape (an annular shape).

The drive control part may drive the drive parts 160*b*, 160*c*, 160*d*, and 160*e* to control to press the lower punch 13 to the upper punch 11 side in a state in which the upper punch 11 is fixed and move the stripper 12*a* of the upper mold 12 and the movable lower die 14*a* of the lower mold 14 to the first mold (the stripper 12*a* of the upper mold 12) side.

<An Example of the Operation of the Forging Device 100>

Figure 4A:
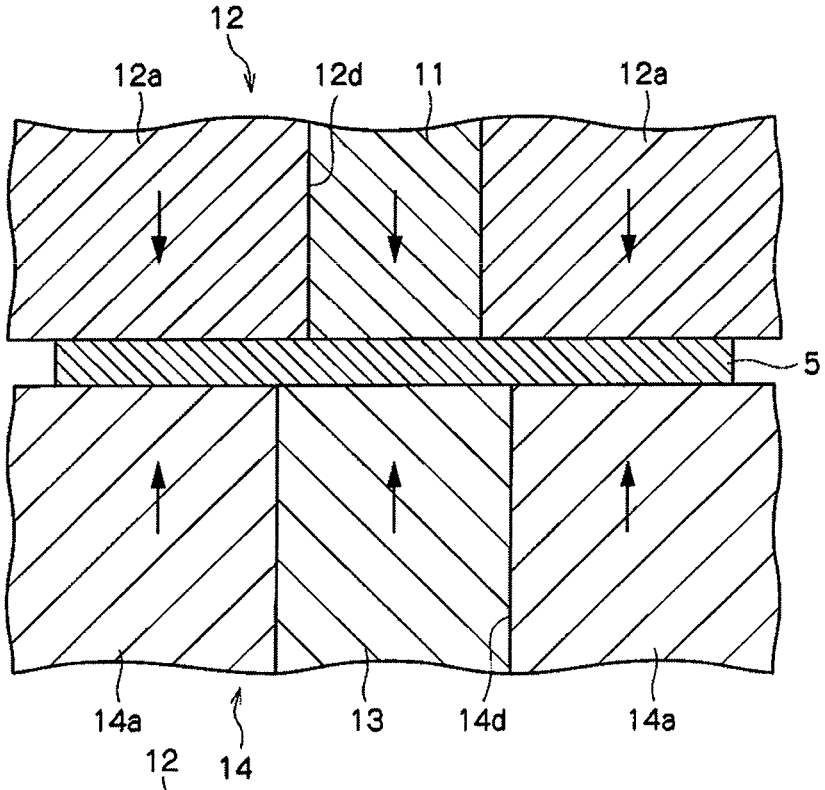
FIGS. 4(*a*) and 4(*b*) are sectional views showing an example of the operation of the forging device according to the embodiment of the present invention, wherein FIG. 4(*a*) is a sectional view showing an example of a state in which a forging raw material is compressed by a stripper of an upper mold and a movable lower die of a lower mold and an upper punch and a lower punch and FIG. 4(*b*) is a sectional view showing an example of the raw material caused to plastically flow.
Figure 4B:
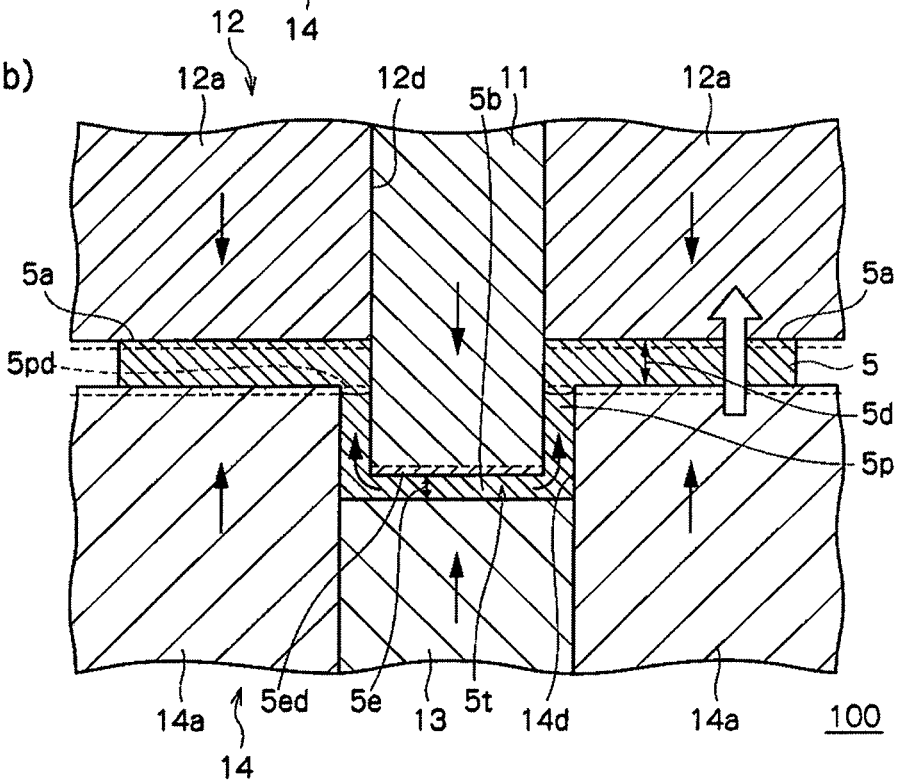
Figure 5:
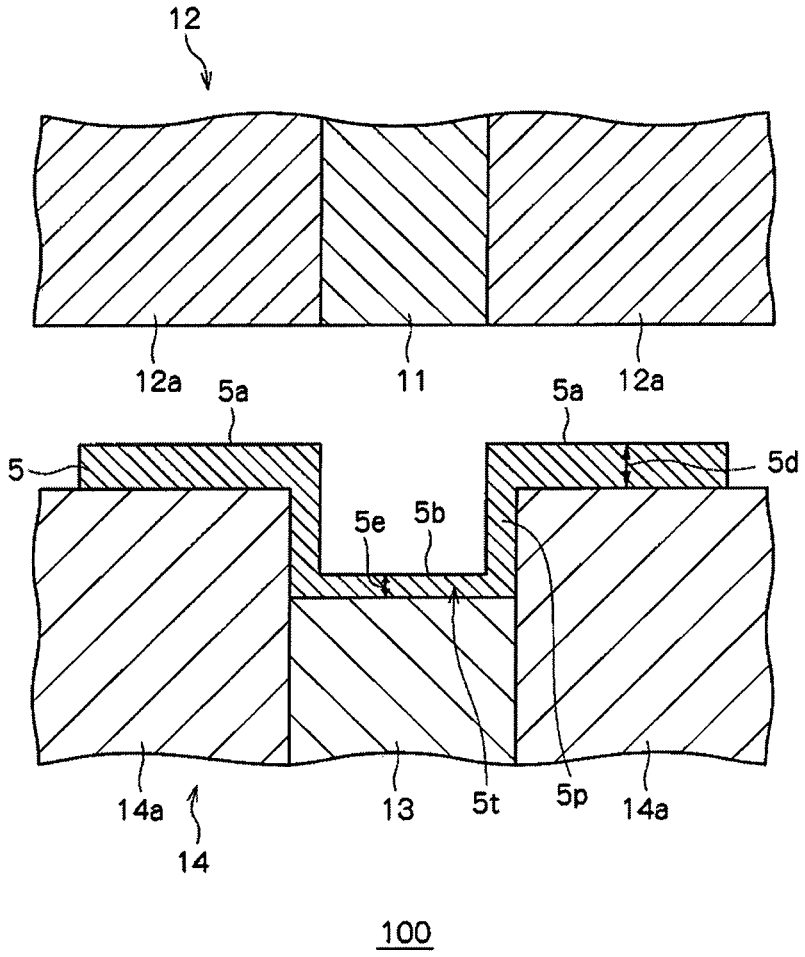
FIG. 5 is a diagram showing an example of a state in which the upper punch is separated from the raw material shaped by the forging device according to the embodiment of the present invention.

FIG. 4 is a sectional view showing an example of the operation of the forging device 100 according to the embodiment of the present invention. FIG. 4(*a*) is a sectional view showing a state in which the raw material 5 is compressed by the upper mold 12 and the lower mold 14 and the upper punch 11 and the lower punch 13. FIG. 4(*b*) is a sectional view showing an example of the raw material 5 caused to plastically flow. FIG. 5 is a diagram showing an example of a state in which the upper punch 11 is separated from the raw material 5 shaped by the forging device 100.

Figures 6, 6B, 6C, 6D:
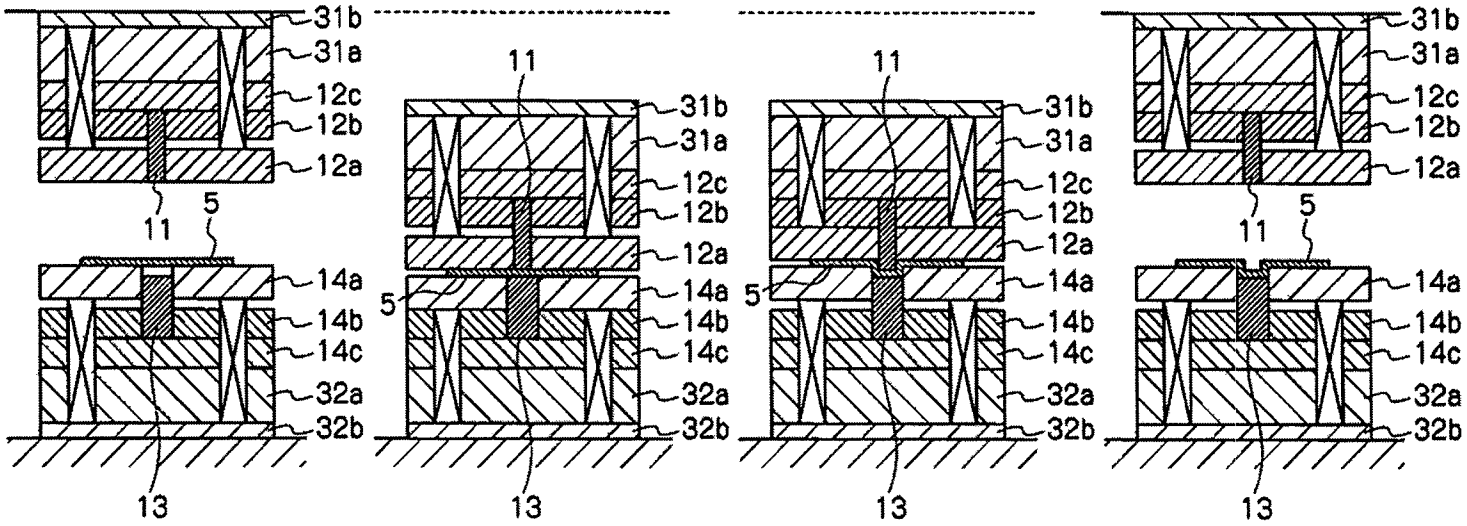
FIGS. 6(*a*)-6(*d*) are diagrams showing an example of the operation of the forging device according to the embodiment of the present invention, wherein FIG. 6(*a*) is a diagram showing an example in which an upper die set is positioned in a top dead center, FIG. 6(*b*) is a diagram showing an example in which the upper and lower punches press the raw material, FIG. 6(*c*) is a diagram showing an example in which the upper die set is positioned in a bottom dead center, and FIG. 6(*d*) is a diagram showing an example in which the upper die set is positioned in the top dead center again.

FIG. 6 is a diagram showing an example of the operation of the forging device 100 according to the embodiment of the present invention. Specifically, FIG. 6(*a*) is a diagram showing an example in which the upper die set 212 is positioned in a top dead center, FIG. 6(*b*) is a diagram showing an example in which the upper and lower punches press the raw material, FIG. 6(*c*) is a diagram showing an example in which the upper die set 212 is positioned in a bottom dead center, and FIG. 6(*d*) is a diagram showing an example in which the upper die set 212 is positioned in the top dead center again.

Figure 7:
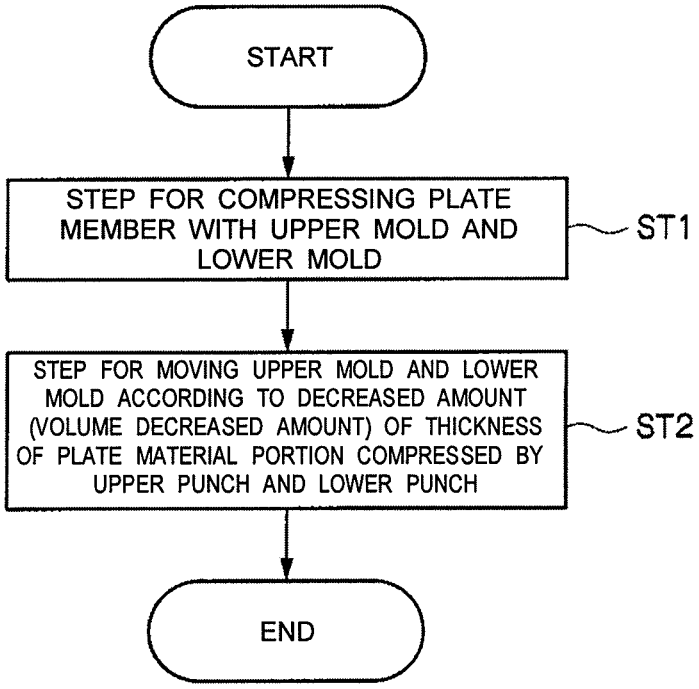
FIG. 7 is a flowchart showing an example of the operation of the forging device according to the embodiment of the present invention.
Figure 8A:
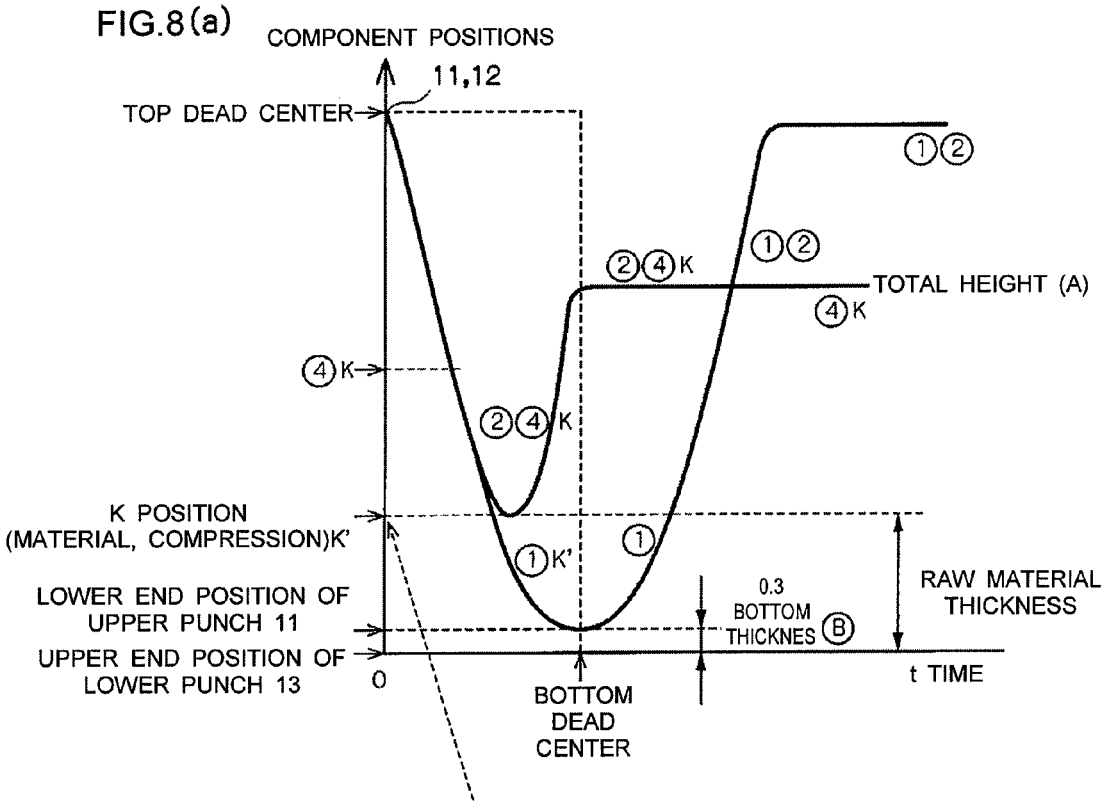
FIGS. 8(*a*) and 8(*b*) are diagrams showing an example of the operation of the forging device according to the embodiment of the present invention, wherein FIG. 8(*a*) is a diagram showing an example of movements of the upper and lower punches, the stripper of the upper mold, and the movable lower die of the lower mold and FIG. 8(*b*) is a sectional view showing an example of the shaped raw material.
Figure 8B:
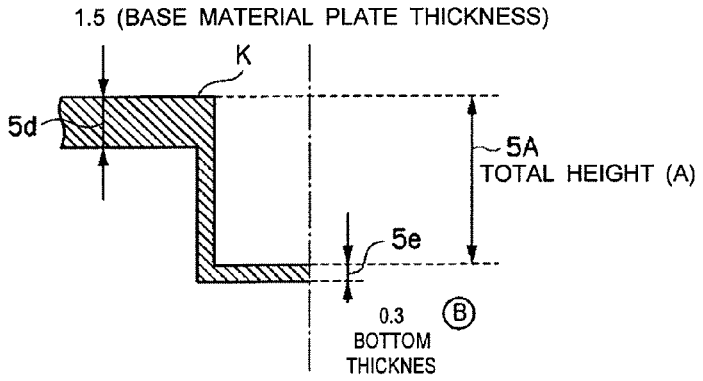

FIG. 7 is a flowchart showing an example of the operation of the forging device 100 according to the embodiment of the present invention. FIG. 8 is a diagram showing an example of the operation of the forging device 100 according to the embodiment of the present invention. Specifically, FIG. 8(*a*) is a diagram showing an example of movements of the upper punch 11, the lower punch 13, the stripper 12*a* of the upper mold 12, and the movable lower die 14*a* of the lower mold 14. FIG. 8(*b*) is a sectional view showing an example of the shaped raw material 5. In FIG. 8(*a*), lines indicates the lower end position of the upper punch 11, the lower end position of the stripper 12*a* of the upper mold 12, the upper end position of the movable lower die 14*a* of the lower mold 14, and the upper end position of the lower punch 13.

Next, an example of the operation of the forging device 100 is explained with reference to FIG. 1 to FIG. 8.

In an initial state, the control part 110 of the forging device 100 sets the drive part 160*a* to locate the slide member 21 in the top dead center. In this state, as shown in FIG. 3, the stripper 12*a* of the upper mold 12 and the upper punch 11 are separated from the movable lower die 14*a* of the lower mold 14 and the lower punch 13.

Figure 3:
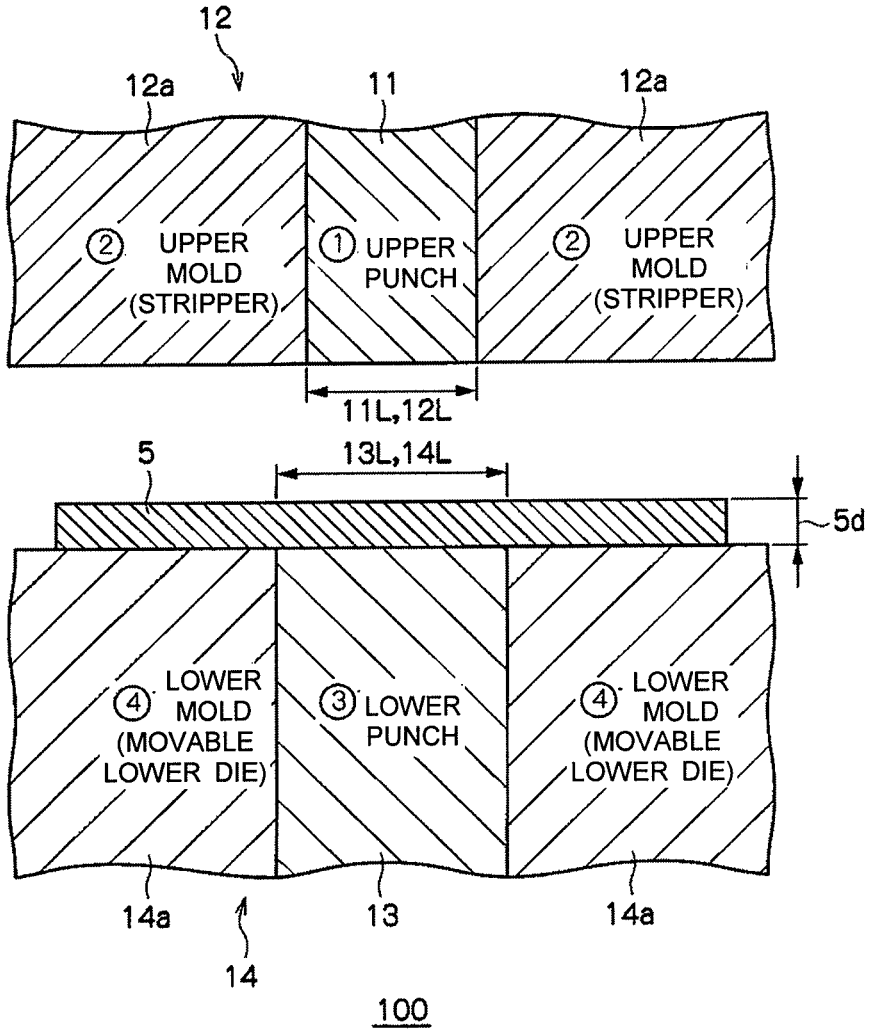
FIG. 3 is a diagram for explaining an example of the operation of the forging device according to the embodiment of the present invention.

As shown in FIG. 3, the plate material, which is the forging target raw material 5, is placed on the movable lower die 14*a* of the lower mold 14 and the lower punch 13. In this case, the raw material 5 is disposed on the lower punch 13 to coincide with a forming position of a cylindrical body in a raw material such as a plate material.

As shown in FIG. 3, the second hole part 14*d* formed in the lower holder 14*b* of the lower mold 14 is formed in a position corresponding to the first punch 11 (the upper punch) and formed with an inner diameter dimension 14L (the outer dimension of the lower punch 13) larger than an outer dimension 11L of the end part of the first punch 11 (the upper punch) (the inner dimension of the hole part of the stripper 12*a* and the upper mold 12).

Subsequently, in step ST1, as shown in FIG. 4(*a*), the control part 110 drives the drive part 160 and compresses the vicinity of the end part of the raw material 5 with the stripper 12*a* of the upper mold 12, which is the first mold, and the movable lower die 14*a* of the lower mold 14, which is the second mold. In this case, the control part 110 compresses the vicinity of the center of the raw material 5 with the upper punch 11 and the lower punch 13.

In step ST2, as shown in FIG. 4(*b*), when the control part 110 drives the drive part 160 (160*a*, 160*b*, 160*c*, and 160*d*) and performs control of driving the first punch 11 (the upper punch) and the second punch 13 (the lower punch) to decrease the thickness of the raw material portion (the plate material) compressed by the first punch 11 (the upper punch) and the second punch 13 (the lower punch), in accordance with the decreased amount (the volume decreased amount: the decrease portion 5*ed*) of the thickness 5*e* of the raw material portion 5*b* compressed by the first punch 11 (the upper punch) and the second punch 13 (the lower punch), in a state in which the thickness of the raw material portion compressed by the stripper 12*a* of the upper mold 12 and the movable lower die 14*a* of the lower mold 14 is substantially maintained, the control part 110 performs drive control to move the raw material portion 5*a* compressed by the stripper 12*a* of the upper mold 12 and the movable lower die 14*a* of the lower mold 14 to the stripper 12*a* side of the upper mold 12 and enlarge the cylindrical part 5*p* formed by causing a material to flow into the gap between the first punch 11 (the upper punch) and the second hole part 14*d*.

The forging device 100 performs the drive control explained above. Therefore, during the processing of the raw material 5, the forging device 100 can perform shaping such that a portion other than a processed part of the raw material 5 is not drawn into the processed part, the raw material does not project from the processed part, and a tabular shape is not affected.

Subsequently, as shown in FIG. 5, the control part 110 drives the drive part 160 and moves the upper die set 212 of the slide member 21, the stripper 12*a* of the upper mold 12, and the upper punch 11 upward.

Specifically, as shown in FIG. 8, an upper end part position k of the raw material 5 (a lower end part position of the upper mold 12) moves to rise according to a decreased amount of the plate thickness of a portion compressed by the upper punch 11 and the lower punch 13.

Figure 9A:
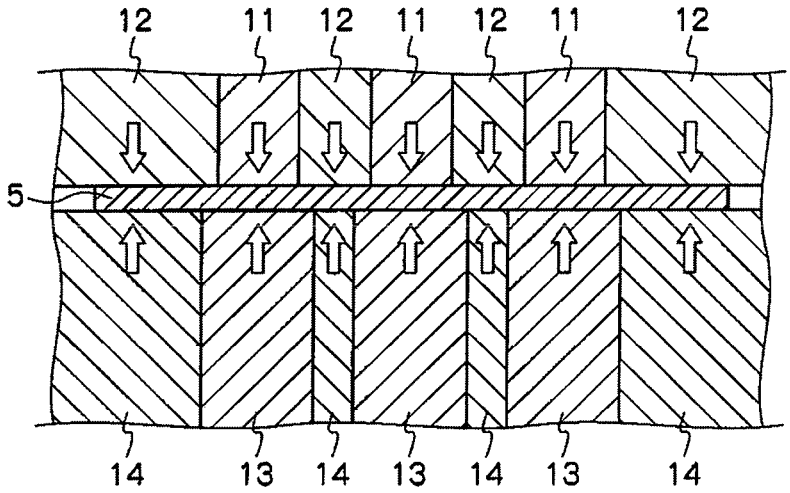
FIGS. 9(*a*)-9(*c*) are diagrams showing an example of the raw material shaped by a forging device including a plurality of upper and lower punches, wherein FIG. 9(*a*) is a sectional view showing an example of a state in which the raw material is compressed by the stripper of the upper mold, the movable lower die of the lower mold, the upper punches, and the lower punches, FIG. 9(*b*) is a sectional view showing an example of the raw material compressed by the upper punches and the lower punches and caused to plastically flow, and FIG. 9(*c*) is a diagram showing an example of a state in which the stripper of the upper mold and the movable lower die of the lower mold are separated.
Figure 9B:
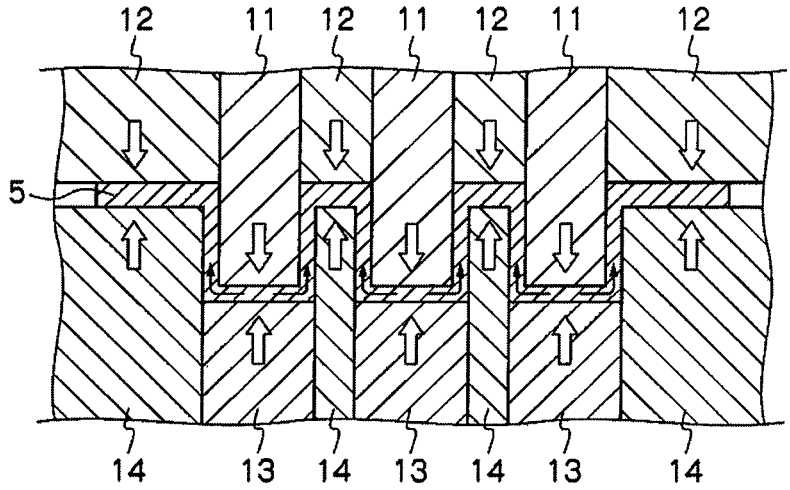
Figure 9C:
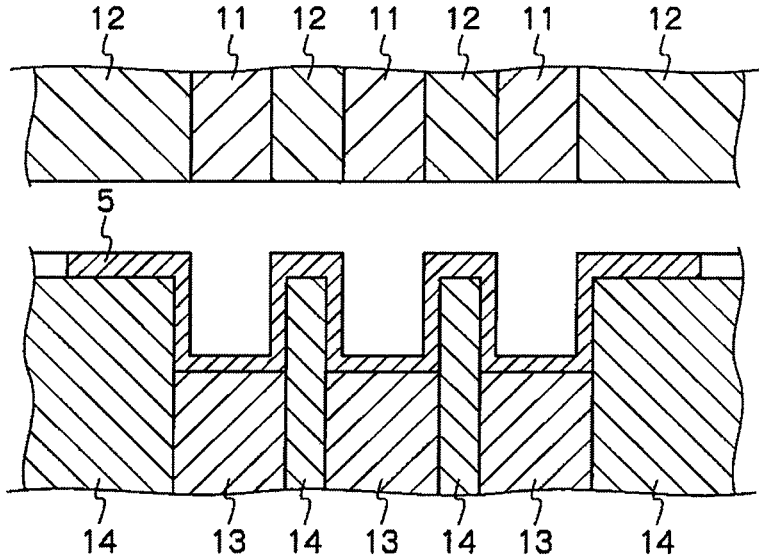

FIG. 9 is a diagram showing an example of the forging device 100 including a plurality of upper punches 11 and a plurality of lower punches 13. Specifically, FIG. 9(*a*) is a sectional view showing an example in which the raw material 5 is compressed by the stripper 12*a* of the upper mold 12, the movable lower die 14*a* of the lower mold 14, and the upper punch 11 and the lower punch 13. FIG. 9(*b*) is a sectional view showing an example of the raw material 5 compressed by the upper punch 11 and the lower punch 13 and caused to plastically flow. FIG. 9(*c*) is a diagram showing an example of a state in which the stripper 12*a* of the upper mold 12 and the movable lower die 14*a* of the lower mold 14 are separated.

In the forging device 100 shown in FIG. 9, the upper punches 11 are respectively provided to be pierceable through a plurality of hole parts formed in the stripper 12*a* of the upper mold 12 and the lower punches 13 are respectively provided in a plurality of hole parts formed in the movable lower die 14*a* of the lower mold 14.

As explained above, during the processing of the raw material 5 such as the plate material, the forging device 100 can perform shaping such that a portion other than a processed part of the raw material 5 is not drawn into the processed part, the material of the raw material does not project from the processed part, and a tabular shape portion of the raw material is not affected. Therefore, the forging device 100 shown in FIG. 9 can process-shape a cylindrical shape continuously in close contact with the raw material 5 such as the plate material.

The operation of the forging device 100 shown in FIG. 9 is explained in detail below.

As shown in FIG. 9(*a*), the control part 110 of the forging device 100 compresses the raw material 5 such as the plate material with the stripper 12*a* of the upper mold 12 and the movable lower die 14*a* of the lower mold 14 and compresses the raw material 5 with the plurality of upper punches 11 and the plurality of lower punches 13.

As shown in FIG. 9(*b*), when the control part 110 drives the drive part 160 (160*a*, 160*b*, 160*c*, and 160*d*) and performs control of driving the first punches 11 (the upper punches) and the second punches 13 (the lower punches) to decrease the thickness of the raw material portion compressed by the plurality of first punches 11 (upper punches) and the plurality of second punches 13 (lower punches), in accordance with the decreased amount (the volume decreased amount: the decrease portion 5*ed*) of the thickness 5*e* of the raw material portions 5*b* compressed by the first punches 11 (the upper punches) and the second punches 13 (the lower punches), in a state in which the thickness of the raw material portion compressed by the stripper 12*a* of the upper mold 12, which is the first mold, and the movable lower die 14*a* of the lower mold 14, which is the second mold, is substantially maintained, the control part 110 performs drive control to move the raw material portion 5*a* compressed by the stripper 12*a* of the upper mold 12 and the lower mold 14 to the stripper 12*a* side of the upper mold 12 and enlarge the cylindrical parts 5*p* formed by causing a material to flow into the gaps between the first punches 11 (the upper punches) and the second hole parts 14*d*.

In this case, the control part 110 of the forging device 100 performs control of driving the drive part 160 such that a portion other than a processed part of the raw material 5 such as the plate material is not drawn into the processed part, the material of the raw material does not project from the processed part, and a tabular shape portion of the raw material is not affected.

As shown in FIG. 9(*c*), the control part 110 of the forging device 100 drives the drive part 160 and moves the upper die set 212 of the slide member 21, the stripper 12*a* of the upper mold 12, the upper punch 11, and the like upward.

In this way, the forging device 100 can shape a bottomed cylindrical body continuously in close contact with the raw material 5 such as the plate material.

Figures 10A, 10B, 10C, 10D, 10E, 10F, 10G, 10H, 10I, 10J:
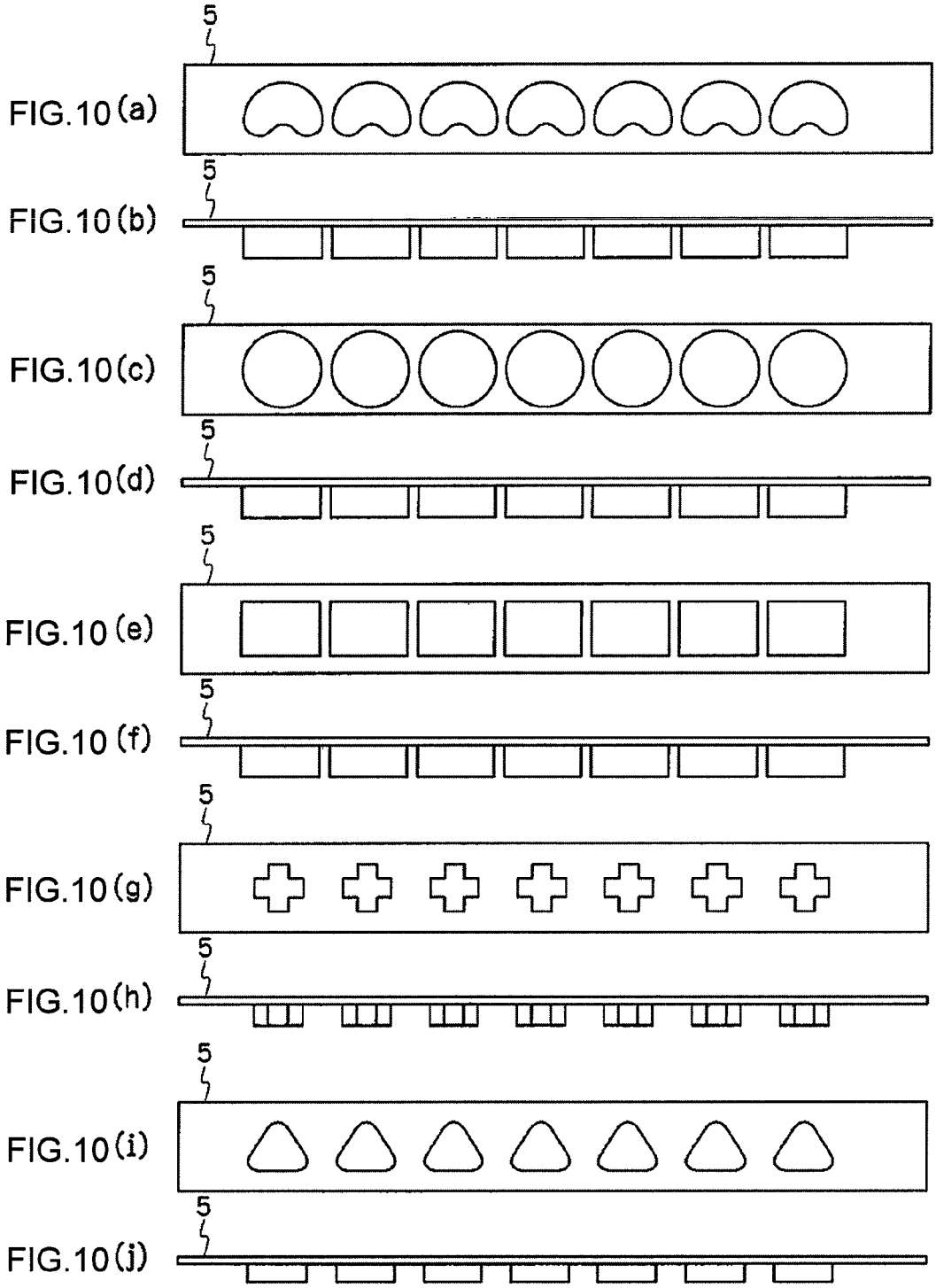
FIGS. 10(*a*)-10(*j*) are diagrams showing examples of the raw material in which a plurality of cylindrical parts are shaped, wherein FIG. 10(*a*) is a top view of a material shaped by a forging device according to a first specific example, FIG. 10(*b*) is a side view of FIG. 10(*a*), FIG. 10(*c*) is a top view of the raw material shaped by a forging device according to a second specific example, FIG. 10(*d*) is a side view of FIG. 10(*c*), FIG. 10(*e*) is a top view of the raw material shaped by a forging device according to a third specific example, FIG. 10(*f*) is a side view of FIG. 10(*e*), FIG. 10(*g*) is a top view of the raw material shaped by a forging device according to a fourth specific example, FIG. 10(*h*) is a side view of FIG. 10(*g*), FIG. 10(*i*) is a top view of the raw material shaped by a forging device according to a fifth specific example, and FIG. 10(*j*) is a side view of FIG. 10(*i*).
Figure 11:
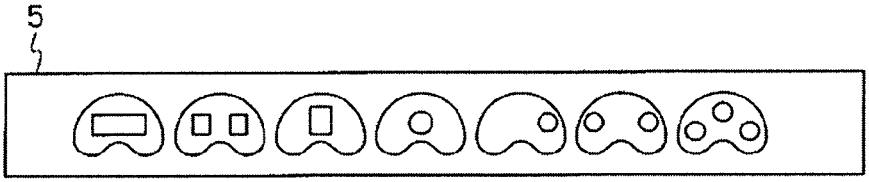
FIGS. 11(*a*) and 11(*b*) are diagrams of an example of the raw material in which a plurality of cylindrical parts are shaped, wherein FIG. 11(*a*) is a top view of the raw material shaped by a forging device according to a sixth specific example and FIG. 11(*b*) is a side view of FIG. 11(*a*).
Figure 11:
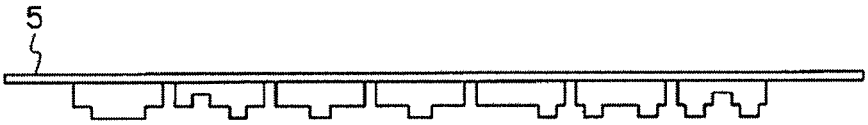

FIG. 10 and FIG. 11 are diagrams showing examples of the raw material 5 in which a plurality of cylindrical shape parts are shaped. In the embodiment, the forging device 100 shapes one forging raw material 5 such as the plate material through the forging processing and manufactures one bottomed cylindrical body 5*t*. However, the forging device 100 is not limited to this form. For example, as shown in FIG. 10, the forging device 100 may be configured to simultaneously shape a plurality of cylindrical bodies 5*t* in one forging raw material 5.

The forging device 100 is not limitedly manufacture the circular cylindrical body. For example, as shown in FIG. 10(*a*) and FIG. 10(*b*), the forging device 100 may be configured to shape a plurality of bottomed cylindrical bodies, the sectional shape of which is a flat elliptical shape (a broad bean shape).

For example, as shown in FIG. 10(*c*) and FIG. 10(*d*), the forging device 100 may be configured to shape a plurality of bottomed circular cylindrical bodies.

As shown in FIG. 10(*e*) and FIG. 10(*f*), the forging device 100 may be configured to shape a plurality of bottomed square cylindrical bodies.

As shown in FIG. 10(*g*) and FIG. 10(*h*), the forging device 100 may be configured to shape a plurality of bottomed cylindrical bodies, the sectional shape of which is a cross shape.

As shown in FIG. 10(*i*) and FIG. 10(*j*), the forging device 100 may be configured to shape a plurality of bottomed cylindrical bodies, the sectional shape of which is a substantially triangular shape.

The forging device 100 may be configured to perform, after shaping bottomed cylindrical parts in the raw material 5, secondary processing and tertiary processing according to necessity to thereby shape the bottomed cylindrical parts in a multistage shape as shown in FIG. 11(*a*) and FIG. 11(*b*). In this case, the raw material 5 can be shaped in a complicated shape.

Figure 12:
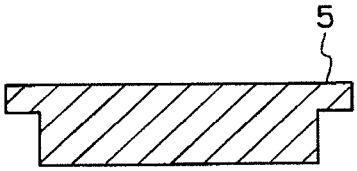
FIGS. 12(*a*) and 12(*b*) are diagrams showing an example of the raw material shaped by a forging device according to a seventh specific example, wherein FIG. 12(*a*) is a top view showing an example of the raw material and FIG. 12(*b*) is a diagram showing an example of the raw material after the shaping.
Figure 12:
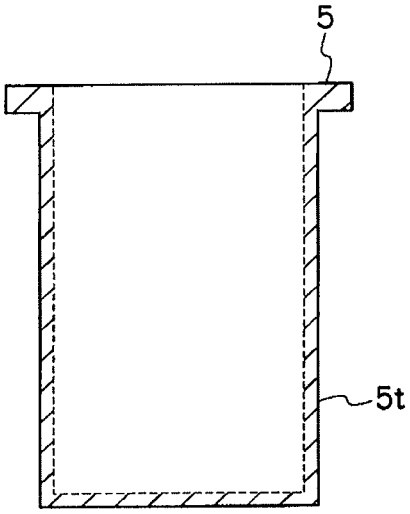
Figure 13A:
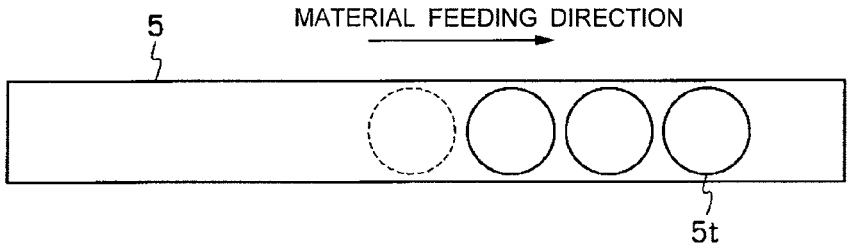
FIGS. 13(*a*)-13(*d*) are diagrams showing another example of the raw material shaped by the forging device, wherein FIG. 13(*a*) is a top view of the raw material after the shaping, FIG. 13(*b*) is a side view of the raw material shown in FIG. 13(*a*), FIG. 13(*c*) is a top view of the raw material after being process-shaped for a plurality of rows and one column at a time, and FIG. 13(*d*) is a top view of the raw material after being process-shaped for a plurality of rows and a plurality of columns at a time.
Figure 13B:
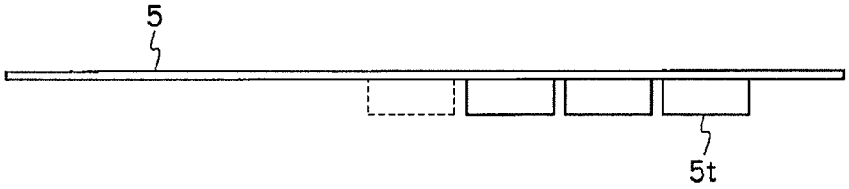
Figure 13C:
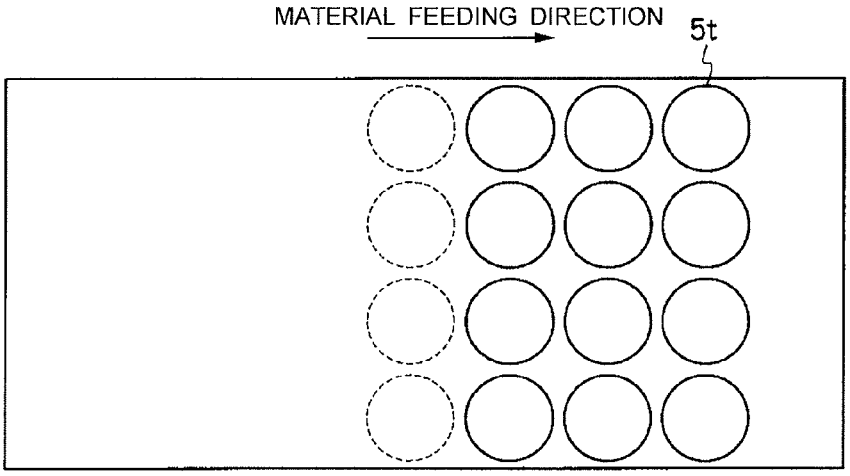
Figure 13D:
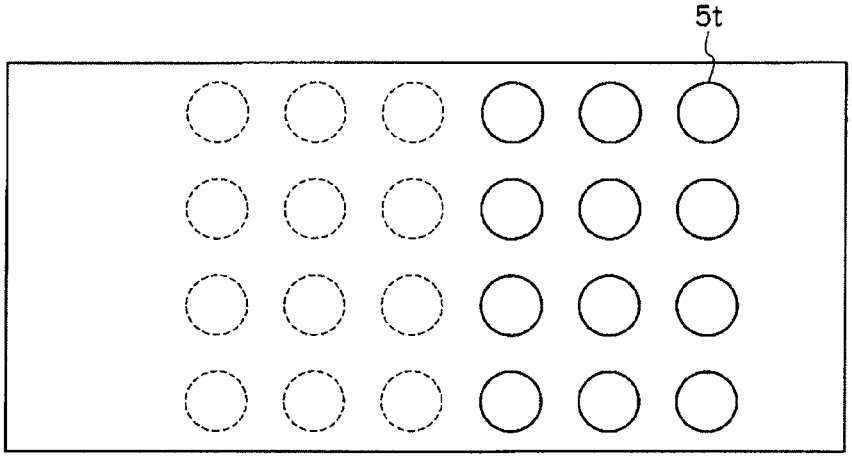

The forging device 100 can easily shape the relatively deep bottomed cylindrical body 5*t* as shown in FIG. 12(*b*) by applying the forging processing according to the present invention to the raw material 5 having a flange shown in FIG. 12(*a*) and preliminarily shaped by upsetting processing. For example, when the relatively deep bottomed cylindrical body 5*t* such as a battery case is manufactured, it is possible to easily manufacture the bottomed cylindrical body 5*t* by adopting the forging processing method according to the present invention.

The upsetting processing is a processing method for compressing a material in a length direction and increasing a cross section of a part or the entire lengths of the material.

As shown in FIG. 13(*a*) and FIG. 13(*b*), the forging device 100 may be configured to shape a plurality of cylindrical bodies 5*t* in the raw material 5 by, for example, processing the cylindrical bodies 5*t* one by one in the plate material of the raw material 5 a plurality of times while shifting a processing place.

For example, as shown in FIG. 13(*c*), the forging device 100 may be configured to shape a plurality of cylindrical bodies 5*t* in the raw material 5 in a matrix shape by processing the plurality of cylindrical bodies 5*t* row by row a plurality of times while shifting a processing place such that the plurality of cylindrical bodies 5*t* are arranged on the plate material of the raw material 5 in a direction orthogonal to a material feeding direction.

For example, as shown in FIG. 13(*d*), the forging device 100 may be configured to shape a plurality of cylindrical bodies 5*t* in the raw material 5 in a matrix shape by processing the plurality of cylindrical bodies 5*t* for a plurality of rows such as three rows at a time a plurality of times while shifting a processing place such that the plurality of cylindrical bodies 5*t* are arranged on the plate material of the raw material 5 in the direction orthogonal to the material feeding direction.

As explained above, the forging device 100 according to the embodiment of the present invention shapes the raw material 5 of forging. The forging device 100 includes the upper mold 12, which is the first mold, and the lower mold 14, which is the second mold, that compress the raw material 5 such as the plate material, specifically, the stripper 12*a* of the upper mold 12 and the movable lower die 14*a* of the lower mold 14, the first punch 11 (the upper punch) provided to be pierceable through the first hole part 12*d* formed in the stripper 12*a* of the upper mold 12, the second punch 13 (the lower punch) provided to be pierceable through the second hole part 14*d* formed in the movable lower die 14*a* of the lower mold 14, and the drive control part (the control part 110 and the drive part 160) that performs control of driving the upper mold 12 and the lower mold 14 and performs control of driving the first punch 11 (the upper punch) and/or the second punch 13 (the lower punch).

The second hole part 14*d* formed in the movable lower die 14*a* of the lower mold 14 is formed in the position corresponding to the first punch 11 (the upper punch) and formed with the inner diameter larger than the outer diameter of the end part of the first punch 11 (the upper punch).

When the drive control part (the control part 110 and the drive part 160) performs control of driving the first punch 11 (the upper punch) and the second punch 13 (the lower punch) to decrease the thickness of the raw material portion compressed by the first punch 11 (the upper punch) and the second punch 13 (the lower punch), in accordance with the decreased amount of the thickness of the raw material portion compressed by the first punch 11 (the upper punch) and the second punch 13 (the lower punch), in the state in which the thickness of the raw material portion compressed by the stripper 12*a* of the upper mold 12 and the movable lower die 14*a* of the lower mold 14 is substantially maintained, the drive control part (the control part 110 and the drive part 160) performs the drive control to move the raw material portion compressed by the stripper 12*a* of the upper mold 12 and the movable lower die 14*a* of the lower mold 14 to the stripper 12*a* side of the upper mold 12 and enlarge the cylindrical part formed by causing the material to flow into the gap between the first punch 11 (the upper punch) and the second hole part 14*d*.

Specifically, the drive control part (the control part 110 and the drive part 160) performs the drive control to move the raw material portion compressed by the stripper 12*a* of the upper mold 12 and the movable lower die 14*a* of the lower mold 14 to the stripper 12*a* side of the upper mold such that the decreased amount (the volume decreased amount: the decrease portion 5*ed*) of the thickness of the raw material portion compressed by the first punch 11 and the second punch 13 and the increase amount (the volume increase amount: the increase portion 5*pd*) of the cylindrical part 5*p* formed by causing the material to flow into the gap between the first punch 11 (the upper punch) and the second hole part 14*d* are the same or substantially the same.

Therefore, it is possible to provide the forging device 100 that can simply and highly accurately perform, in a short time, processing for forging the raw material 5 such as a preliminarily shaped raw material into a bottomed cylindrical shape.

During processing of the raw material 5, the forging device 100 according to the embodiment of the present invention can apply the forging processing to the raw material 5 such that a portion other than a processed part of the raw material 5 is not drawn into the processed part, the material of the raw material 5 does not project from the processed part, and a tabular shape portion of the raw material 5 is not affected. Therefore, as shown in FIG. 8, the forging device 100 can shape a bottomed cylindrical part continuously in close contact with the raw material 5.

In the forging device 100, it is possible to form a bottomed cylindrical body having a desired shape by adopting a desired shape such as a square shape, a polygonal shape, or a circular shape as the shape of the lower end part of the upper punch 11, the shape of the hole part 14*d* of the lower mold 14, and the like. Therefore, a shaped object formed by shaping the raw material 5 with the forging device 100 is a desired cylindrical body such as a bottomed square cylindrical body, a bottomed polygonal cylindrical body, or a bottomed circular cylindrical body.

As explained above, the forging method according to the embodiment of the present invention is a forging method for the forging device 100 that shapes the forging raw material 5. The forging method includes a first step in which the drive control part (the control part 110 and the drive part 160) compresses the raw material 5 such as the plate material with the upper mold 12, which is the first mold, and the lower mold 14, which is the second mold, specifically, the stripper 12*a* of the upper mold 12 and the movable lower die 14*a* of the lower mold 14 and a second step in which, when the drive control part (the control part 110 and the drive part 160) performs control of driving the first punch 11 (the upper punch) and/or the second punch 13 (the lower punch) to decrease the thickness of the raw material portion compressed by the first punch 11 (the upper punch) and the second punch 13 (the lower punch), in accordance with the decreased amount of the thickness of the plate material portion compressed by the first punch 11 (the upper punch) and the second punch 13 (the lower punch), in the state in which the thickness of the plate material portion compressed by the stripper 12*a* of the upper mold 12 and the movable lower die 14*a* of the lower mold 14 is substantially maintained, the drive control part (the control part 110 and the drive part 160) performs the drive control to move the plate material portion compressed by the upper mold 12 and the lower mold 14 (the lower mold) to the stripper 12*a* side of the upper mold 12 and enlarge the cylindrical part 5*p* formed by causing the material to flow into the gap between the first punch 11 (the upper punch) and the second hole part 14*d*.

That is, it is possible to provide the forging method that can simply and highly accurately perform, in a short time, processing for forging the tabular raw material 5 into a bottomed cylindrical shape.

For example, compared with when the drawing/ironing processing and the trim processing are repeatedly performed, the forging device 100 according to the embodiment of the present invention can reduce processes for performing the trim processing. Therefore, the forging device 100 can perform processing with a high material use ratio.

As explained above, the forging device 100 according to the embodiment of the present invention shapes the forging raw material 5 such as the plate material made of metal according to the backward extrusion forging processing, the backpressure applying forging processing, and the cold forging processing. Therefore, it is possible to provide the forging device 100 that can highly accurately perform, in a short time, processing for forging the raw material 5 into a bottomed cylindrical shape.

In the forging device 100 according to the embodiment of the present invention, the drive control part (the control part 110 and the drive part 160) performs the drive control to apply, to the stripper 12*a* of the upper mold 12, which is the first mold, a first constraint force independent from force applied to the first punch 11 (the upper punch) and apply, to the movable lower die 14*a* of the lower mold 14, which is the second mold, a second constraint force independent from the force applied to the first punch 11. In this case, the second constraint force is desirably larger than the first constraint force.

Consequently, it is possible to easily shape the plate material, which is the raw material 5, and form the cylindrical part 5*p* with simple drive control.

The drive control part (the control part 110 and the drive part 160) performs the forging processing such that the raw material 5 does not project along the upper punch 11 or is not drawn in along the upper punch 11 and the hole part 14*d* because of a material flow of the raw material 5. Therefore, it is possible to simply shape a bottomed cylindrical body.

Note that, in the forging device 100 in the embodiment, the lower punch 13 is fixed to the base 20 and the plate material portion compressed by the stripper 12*a* of the upper mold 12 and the movable lower die 14*a* of the lower mold 14 is moved to the stripper 12*a* side of the upper mold 12 (the upward direction). However, the forging device 100 is not limited to this form.

For example, the forging device 100 may be configured to move the plate material portion compressed by the upper punch 11 and the lower punch 13 downward in a state in which the raw material 5 such as the plate material is compressed by the upper punch 11 and the lower punch 13 and in a state (fixed) in which the raw material 5 is compressed by the stripper 12*a* of the upper mold 12 and the movable lower die 14*a* of the lower mold 14.

The forging device 100 may be configured to move the plate material portion compressed by the upper punch 11 and the lower punch 13 in a direction away from the plate material portion compressed by the stripper 12*a* of the upper mold 12 and the movable lower die 14*a* of the lower mold 14 in a state in which the raw material 5 is compressed by the upper punch 11 and the lower punch 13 and in a state in which the raw material 5 is compressed by the stripper 12*a* of the upper mold 12 and the movable lower die 14*a* of the lower mold 14.

<Forging Device According to Another Embodiment of the Present Invention>

Figure 14:
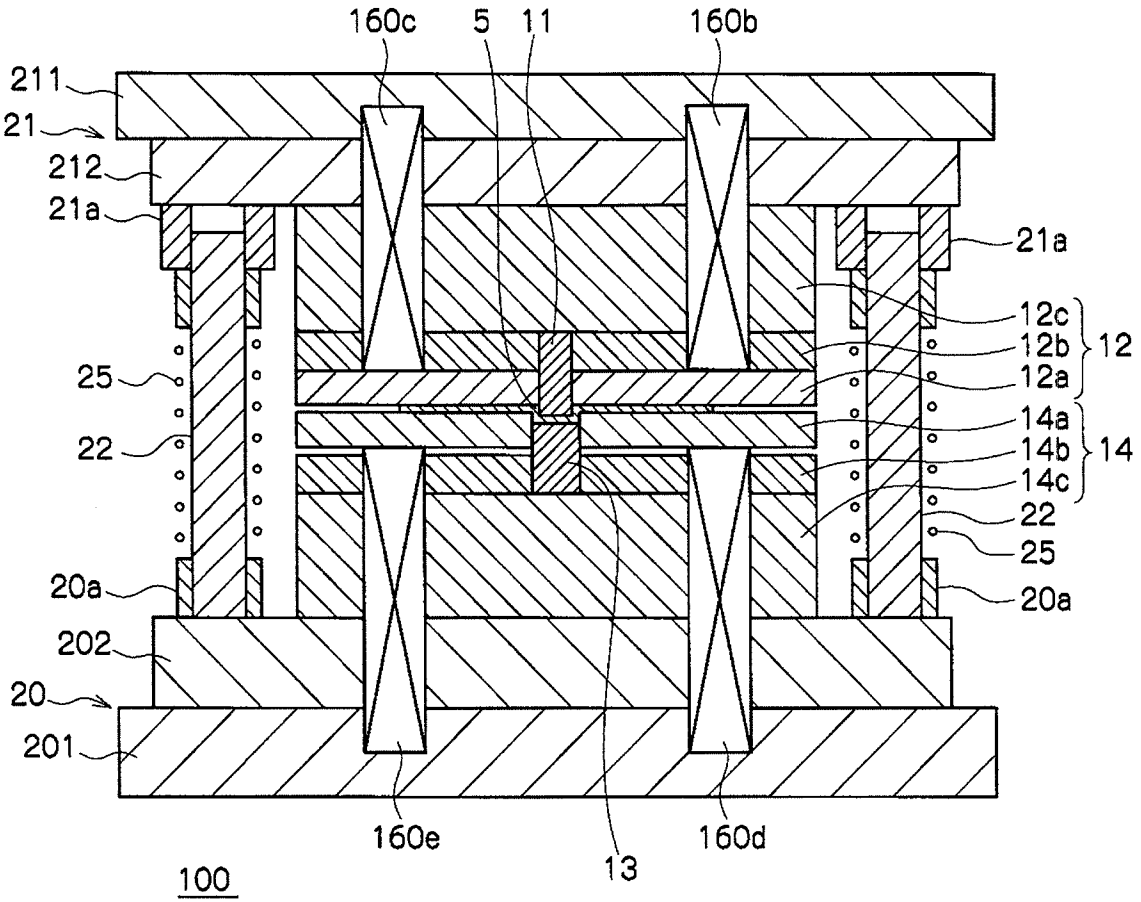
FIG. 14 is a diagram showing an example of a forging device according to another embodiment of the present invention.

FIG. 14 is a diagram showing an example of a forging device according to another embodiment of the present invention.

The forging device 100 shown in FIG. 14 has structure in which a driving device (a drive part) is built in a press machine.

Specifically, the forging device shown in FIG. 14 includes the first punch 11 (the upper punch), the second punch 13 (the lower punch), the upper mold 12, and the lower mold 14.

The upper mold 12 includes the stripper 12*a*, the upper holder 12*b*, and the upper plate 12*c*. The lower mold 14 includes a movable lower die 14*a* (the lower stripper), the lower holder 14*b*, and the lower plate 14*c*. The forging device in this embodiment includes the control part 110 (the CPU), the operation input part 120, the display part 130, the storing part 140, the position detecting part 150, and the drive part 160 (160*a*, 160*b*, 160*c*, 160*d*, and 160*e*) (not shown in the figure).

Compared with the forging device shown in FIG. 1, in the forging device 100 shown in FIG. 14, the upper pressing plate 31*b*, the upper spring holder 31*a*, the lower spring holder 32*a*, and the lower pressing plate 32*b* are not provided.

The forging device 100 shown in FIG. 14 has structure in which the upper end parts of the drive parts 160*d* and 160*e* are connected to the movable lower die 14*a* and the lower end parts thereof are connected to the press bolster 201 and has structure in which the upper end parts of the drive parts 160*b* and 160*c* are connected to the press slide 211 and the lower end parts thereof are connected to the stripper 12*a*.

In the forging device 100 shown in FIG. 14, the control part 110 is configured to be capable of operating the stripper 12*a* and the movable lower die 14*a* at a relatively large stroke by driving the drive parts 160*a*, 160*b*, 160*c*, 160*d*, and 160*e*.

As explained above, it is possible to provide the forging device 100 having relatively large movable ranges of the stripper 12*a* and the movable lower die 14*a*.

Explanation is omitted concerning the same components in the forging device shown in FIG. 14 and the forging device shown in FIG. 1 and the like.

The embodiments of the present invention are explained above. However, a part or all of the embodiments of the present invention are described like the following notes.

[Note 1]

A forging device that shapes a raw material of forging, the forging device including:

a first mold (an upper mold) and a second mold (a lower mold) that compress the raw material;

a first punch (an upper punch) provided to be pierceable through a first hole part formed in the first mold (the upper mold);

a second punch (a lower punch) provided to be pierceable through a second hole part formed in the second mold (the lower mold); and a drive control part that performs control of driving the first mold (the upper mold) and the second mold (the lower mold) and control of driving the first punch (the upper punch) and/or the second punch (the lower punch), wherein the second hole part formed in the second mold (the lower mold) is formed in a position corresponding to the first punch (the upper punch) and formed with an inner dimension larger than the outer dimension of an end part of the first punch (the upper punch), when the drive control part performs control of driving the first punch (the upper punch) and/or the second punch (the lower punch) to decrease the thickness of a raw material portion compressed by the first punch (the upper punch) and the second punch (the lower punch), in accordance with a decreased amount of the thickness of the raw material portion compressed by the first punch (the upper punch) and the second punch (the lower punch), in a state in which the thickness of the raw material portion compressed by the first mold (the upper mold) and the second mold (the lower mold) is substantially maintained, the drive control part performs drive control to move the raw material portion compressed by the first mold (the upper mold) and the second mold (the lower mold) to the first mold (the upper mold) side and enlarge a cylindrical part formed by causing a material to flow into a gap between the first punch (the upper punch) and the second hole part.

[Note 2]

The forging device according to note 1, wherein the drive control part performs drive control to move the raw material portion compressed by the first mold (the upper mold) and the second mold (the lower mold) to the first mold (the upper mold) side such that a decreased amount (a volume decreased amount) of the thickness of the raw material portion by the first punch and the second punch and an increase amount (a volume increase amount) of a cylindrical part formed by causing the material to flow into the gap between the first punch (the upper punch) and the second hole part are the same or substantially the same.

[Note 3]

The forging device according to note 1 or note 2, wherein the drive control part performs drive control to apply, to the first mold (the upper mold), a first constraint force independent from force applied to the first punch and apply, to the second mold (the lower mold), a second constraint force independent from the force applied to the first punch, and the second constraint force is larger than the first constraint force.

[Note 4]

The forging device according to any one of note 1 to note 3, wherein a shaped object formed by shaping the raw material is at least one of a bottomed square cylindrical body, a bottomed polygonal cylindrical body, or a bottomed circular cylindrical body.

[Note 5]

A forging method for a forging device that shapes a raw material, which is a forging raw material, the forging device including: a first mold (an upper mold) and a second mold (a lower mold) that compress the raw material; a first punch (an upper punch) provided to be pierceable through a first hole part formed in the first mold (the upper mold); a second punch (a lower punch) provided to be pierceable through a second hole part formed in the second mold; (the lower mold); and a drive control part that performs control of driving the first mold (the upper mold) and the second mold (the lower mold) and the first punch (the upper punch) and/or the second punch (the lower punch), the second hole part formed in the second mold (the lower mold) being formed in a position corresponding to the first punch (the upper punch) and formed with an inner dimension larger than the outer dimension of an end part of the first punch (the upper punch), and the forging method including: a step in which the drive control part compresses the raw material with the first mold (the upper mold) and the second mold (the lower mold); and a step in which, when the drive control part performs control of driving the first punch (the upper punch) and the second punch (the lower punch) to decrease the thickness of a raw material portion compressed by the first punch (the upper punch) and the second punch (the lower punch), in accordance with a decreased amount of the thickness of the raw material portion compressed by the first punch (the upper punch) and the second punch (the lower punch), in a state in which the thickness of the raw material portion compressed by the first mold (the upper mold) and the second mold (the second mold) is substantially maintained, the drive control part performs drive control to move the raw material portion compressed by the first mold (the upper mold) and the second mold (the lower mold) to the first mold (the upper mold) side and enlarge a cylindrical part formed by causing a material to flow into a gap between the first punch (the upper punch) and the second hole part.

The embodiments of the present invention are explained in detail above with reference to the drawings. However, a specific configuration is not limited to these embodiments. A change in design and the like in a range not departing from the spirit of the present invention are included in the present invention.

The described contents of the embodiments shown in the figures referred to above can be combined with one another as long as there are no particular contradiction and problem in the purposes, the configurations, and the like of the embodiments.

The described contents of the figures can be embodiments independent from one another. Embodiments of the present invention are not limited to one embodiment obtained by combining the figures.

REFERENCE SIGNS LIST

5 Raw material (Plate material, a preliminarily shaped raw material or the like: a forging processing target)

5*a* Raw material (plate material) portion compressed by a stripper

5*b* Raw material (plate material) portion compressed by an upper punch and a lower punch

5*d* Thickness of the raw material (the plate material) (Thickness of the raw material before forging processing, Thickness of the raw material portion compressed by the upper mold and the lower mold)

5*e* Thickness of the raw material (the plate material) (Thickness of the raw material portion compressed by the upper punch and the lower punch through the forging processing)

5*ed* Decrease portion

5*p* Cylindrical part

5*pd* Enlarge portion

5*t* Cylindrical body

11 Upper punch (First punch)

11L Outer dimension of the upper punch

12 Upper mold (First mold: stripper)

12*a* Stripper

12*b* Upper holder

12*c* Upper plate

12*d* Hole part

13 Lower Punch (Second punch)

14 Lower mold (Second mold: movable lower die)

14*a* Movable lower die (Lower stripper)

14*b* Lower holder

14*c* Lower plate

14*d* Hole part

20 Base (Lower die set and press bolster)

21 Slide member (Press slide and upper die set)

22 Rod (Slide guide)

25 Urge member (Spring)

31 Upper block

32 Lower block

100 Forging device

110 Control part (CPU)

120 Operation input part

130 Display part

140 Storing part

150 Position detecting part (Sensor)

160 Drive part

201 Press bolster

202 Lower die set

211 Press slide

212 Upper die set

What is claimed is:

1. A forging device that shapes a raw material, the forging device comprising:

a first mold and a second mold that compress the raw material;

a first punch that is pierceable through a first hole provided in said first mold;

a second punch that is pierceable through a second hole provided in said second mold; and a drive controller that controls driving of said first mold and said second mold and controls driving of said first punch and/or said second punch, wherein said second hole in said second mold is provided at a position corresponding to said first punch and has an inner dimension larger than an outer dimension of an end part of said first punch, said first punch has an outer dimension almost the same as an inner dimension of said first hole to slidably pierce through said first hole and has a same outer dimension, from a portion in sliding contact with said first hole to an end part on a side of said second punch, and said second hole has an inner dimension larger than the inner dimension of said first hole, when said drive controller controls driving of said first punch and/or said second punch to decrease a thickness of a raw material portion compressed by said first punch and said second punch, in accordance with a decreased thickness of the raw material portion compressed by said first punch and said second punch, while the thickness of the raw material portion compressed by said first mold and said second mold is substantially maintained, said drive controller controls movement of said first mold, said second mold and the raw material portion compressed by said first mold and said second mold to a side of said first mold and enlarges a cylindrical part formed by causing material to flow into a gap between said first punch and said second hole, after said first mold and said second mold move by a fixed amount to the side of said second punch, while the raw material is held between said first mold and said second mold, said drive controller simultaneously moves said first punch to the side of said second punch and moves said first mold and said second mold in opposite directions, until the thickness of the raw material portion compressed by said first punch and said second punch reaches a predetermined value and, thereafter, stops the movement of said first mold and said second mold and moves said first punch to the side of said first mold.

2. The forging device according to claim 1, wherein said drive controller is configured to apply a first force to the first mold and to apply a second force to the second mold, the first force and the second force each being independent of a force applied to the first punch.

3. The forging device according to claim 2, wherein said drive controller is configured to apply a first force to the first mold and to apply a second force to the second mold, the first force and the second force each being independent of a force applied to the first punch, the second force being larger than the first force.

4. A forging method for shaping a raw material by a forging device, the forging device including: a first mold and a second mold that compress the raw material; a first punch that is pierceable through a first hole provided in the first mold; a second punch that is pierceable through a second hole provided in the second mold; and a drive controller that controls driving of the first mold and the second mold and controls driving of the first punch and/or the second punch, the second hole in the second mold being provided at a position corresponding to the first punch and having an inner dimension larger than an outer dimension of an end part of the first punch, and the first punch has an outer dimension almost the same as an inner dimension of the first hole to slidably pierce through the first hole and has a same outer dimension, from a portion in sliding contact with the first hole to an end part on a side of the second punch, and the second hole has an inner dimension larger than the inner dimension of the first hole, the forging method comprising:

compressing, by the drive controller, the raw material with the first mold and the second mold; and controlling, by said drive controller, driving of said the punch and/or the second punch to decrease a thickness of a raw material portion compressed by the first punch and the second punch, in accordance with a decreased thickness of the raw material portion compressed by the first punch and the second punch, while the thickness of the raw material portion compressed by the first mold and the second mold is substantially maintained, controlling, by the drive controller, movement of the first mold, the second mold and the raw material portion compressed by the first mold and the second mold to a side of the first mold and enlarging a formed cylindrical part by causing a material to flow into a gap between the first punch and the second hole, wherein the controlling by the drive controller includes, after the first mold and the second mold move by a fixed amount to the side of the second punch while the raw material is held between the first mold and the second mold, simultaneously moving the first punch to the side of the second punch and moving the first mold and the second mold in opposite directions, until the thickness of the raw material portion compressed by the first punch and the second punch reaches a predetermined value and, thereafter, stopping the movement of the first mold and the second mold and moving the first punch to the side of the first mold.

5. The forging method according to claim 4, the controlling further comprising applying a first force to the first mold and applying a second force to the second mold, the first force and the second force each be independent of a force applied to the first punch.

6. The forging method according to claim 5, the controlling further comprising applying a first force to the first mold and applying a second force to the second mold, the first force and the second force each be independent of a force applied to the first punch, the second force being larger than the first force.

7. A forging device that shapes a raw material, the forging device comprising:

a first mold and a second mold that compress the raw material;

a first punch that is pierceable through a first hole provided in said first mold;

a second punch that is pierceable through a second hole provided in said second mold; and a drive controller that controls driving of said first mold, said second mold, and said first punch, wherein said second hole in said second mold is provided at a position corresponding to said first punch and has an inner dimension larger than an outer dimension of an end part of said first punch, when said drive controller moves said first punch to a side of said second punch without moving said second punch to decrease a thickness of a raw material portion compressed by said first punch and said second punch, in accordance with a decreased thickness of the raw material portion compressed by said first punch and said second punch, while the thickness of the raw material portion compressed by said first mold and said second mold is substantially maintained, said drive controller controls movement of said first mold, said second mold and the raw material portion compressed by said first mold and said second mold to a side of said first mold and enlarges a cylindrical part formed by causing material to flow into a gap between said first punch and said second hole, and after said first mold and said second mold move by a fixed amount to the side of said second punch while the raw material is held between said first mold and said second mold, said drive controller simultaneously moves said first punch to the side of said second punch and moves said first mold and said second mold in opposite directions until the thickness of the raw material portion compressed by said first punch and said second punch reaches a predetermined value and, thereafter, stops the movement of said first mold and said second mold and moves said first punch to the side of said first mold.

8. The forging device according to claim 7, wherein said drive controller is configured to apply a first force to the first mold and to apply a second force to the second mold, the first force and the second force each being independent of a force applied to the first punch.

9. The forging device according to claim 8, wherein said drive controller is configured to apply a first force to the first mold and to apply a second force to the second mold, the first force and the second force each being independent of a force applied to the first punch, the second force being larger than the first force.

10. A forging device that shapes a raw material of forging, the forging device comprising:

a first mold and a second mold that compress the raw material;

a first punch that is pierceable through a first hole provided in said first mold;

a second punch that is pierceable through a second hole provided in said second mold; and a drive controller that controls driving of said first mold, said second mold, and said first punch, wherein said second hole in said second mold is provided at a position corresponding to said first punch and has an inner dimension larger than an outer dimension of an end part of said first punch, when said drive controller moves said first punch to a side of said second punch without moving said second punch to decrease a thickness of a raw material portion compressed by said first punch and said second punch, in accordance with a decreased thickness of the raw material portion compressed by said first punch and said second punch, while the thickness of the raw material portion compressed by said first mold and said second mold is substantially maintained, said drive controller controls movement of said first mold, said second mold and the raw material portion compressed by said first mold and said second mold to a side of said first mold and englarges a cylindrical part formed by causing material to flow into a gap between said first punch and said second hole, said first punch and said first mold are provided on a side higher than said second punch and said second mold, a slide member, movable in an up-down direction, is provided on an upper side of said first punch and said first mold, said first punch is fixed to said slide member, said first mold is connected to said slide member via a driver that enables adjustment of a distance between said first mold and said slide member, and a crankshaft that is driven to rotate, said slide member is connected to an eccentric portion of the crankshaft via a connecting rod to move in the up-down direction as a result of rotation of said crankshaft.

11. The forging device according to claim 10, wherein a base is provided on a lower side of said second punch and said second mold, said second punch is fixed to said base, and said second mold is connected to said base via a further driver that enables adjustment of a distance between said second mold and said base.

12. The forging device according to claim 11, wherein a rod that guides sliding, the up-down direction, of said slide member, and a member that urges said slide member upward, are provided between said base and said slide member.

13. The forging device according to claim 10, wherein said drive controller is configured to apply a first force to the first mold and to apply a second force to the second mold, the first force and the second force each being independent of a force applied to the first punch.

14. The forging device according to claim 13, wherein said drive controller is configured to apply a first force to the first mold and to apply a second force to the second mold, the first force and the second force each being independent of a force applied to the first punch, the second force being larger than the first force.

15. A forging method for shaping a raw material by a forging device, the forging device including a first mold and a second mold that compress the raw material, a first punch that is pierceable through a first hole provided in the first mold, a second punch that is pierceable through a second hole provided in the second mold, and a drive controller that controls driving the first mold, the second mold, and the first punch, the second hole in the second mold being provided at a position corresponding to the first punch and having an inner dimension larger than an outer dimension of an end part of the first punch, the forging method comprising:

compressing, by the drive controller, the raw material with the first mold and the second mold;

controlling, by the drive controller, movement of the first punch to a side of the second punch without moving the second punch to decrease a thickness of a raw material portion compressed by the first punch and the second punch, in accordance with a decreased thickness of the raw material portion compressed by the first punch and the second punch, while the thickness of the raw material portion compressed by the first mold and the second mold is substantially maintained;

controlling, by the drive controller, movement of the first mold, the second mold and the raw material portion compressed by the first mold and the second mold to a side of the first mold and enlarging a cylindrical part formed by causing a material to flow into a gap between the first punch and the second hole, wherein the controlling, by the drive controller includes, after the first mold and the second mold move by a fixed amount to the side of the second punch while the raw material is held between the first mold and the second mold, simultaneously moving the first punch to the side of the second punch and moving, the first mold and the second mold in opposite directions, until the thickness of the raw material portion compressed by the first punch and the second punch reaches a predetermined value and, thereafter, stopping the movement of the first mold and the second mold and moving the first punch to the side of the first mold.

16. The forging method according to claim 15, the controlling further comprising applying a first force to the first mold and applying a second force to the second mold, the first force and the second force each being independent of a force applied to the first punch.

17. The forging method according to claim 16, the controlling further comprising applying a first force to the first mold and applying a second force to the second mold, the first force and the second force each being independent of a force applied to the first punch, the second force being larger than the first force.

* * * * *